US006413705B1

(12) United States Patent
Fujikura et al.

(10) Patent No.: US 6,413,705 B1
(45) Date of Patent: Jul. 2, 2002

(54) HEAT-DEVELOPABLE RECORDING MATERIAL

(75) Inventors: Sadao Fujikura; Hiroshi Haraoka, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/977,373

(22) Filed: Oct. 16, 2001

(30) Foreign Application Priority Data

Oct. 16, 2000 (JP) ..... 2000-315335

(51) Int. Cl.[7] ..... G03C 1/498; G03C 1/795; G03C 1/93

(52) U.S. Cl. ..... 430/496; 430/533; 430/619; 430/950

(58) Field of Search ..... 430/496, 533, 430/950, 619

(56) References Cited

U.S. PATENT DOCUMENTS 5,958,659 A * 9/1999 Takahashi ..... 430/533
6,110,659 A * 8/2000 Hatakeyama et al. ..... 430/533
6,165,602 A * 12/2000 Fujita ..... 430/533

* cited by examiner

*Primary Examiner*—Richard L. Schilling
(74) *Attorney, Agent, or Firm*—Birch, Stewart, Kolasch & Birch, LLP

(57) ABSTRACT

A heat-developable recording material comprises a support, at least one undercoat layer and at least one image-forming layer, in this order, wherein the undercoat layer comprises: polyester resins containing at least two kinds of water-soluble and water-dispersible polyester resins, each of which has a different glass transition temperature (Tg); and fine particles having an average particle diameter (k) of from 0.1 μm to 2.0 μm, and the undercoat layer has an average film thickness (d) of from 0.05 μm to 1.0 μm, and (k)/(d) is in the range from 2.0 to 10.0.

7 Claims, No Drawings

HEAT-DEVELOPABLE RECORDING MATERIAL

FIELD OF THE INVENTION

The present invention relates to a heat-developable recording material.

BACKGROUND OF THE INVENTION

In recent years, reduction of waste solutions in processing has strongly been desired in the field of photographic films for medical diagnosis and in the field of photographic films for phototype process from the viewpoints of environmental protection and space saving. Accordingly, techniques regarding heat-developable photosensitive materials have been needed for medical diagnosis films and for phototype process films which are able to be efficiently exposed with a laser image-setter or a laser imager and to form a clear black image of high resolution and sharpness. These heat-developable photosensitive materials make it possible to provide customers with a simpler and environmentally benign heat development processing system without using any solution type processing chemicals.

The similar requirements exist in the field of general image-forming materials. However, the image for medical diagnosis use is especially characterized in that a cold tone image is preferred from the viewpoint of facilitating medical diagnosis. Besides, a high image quality in sharpness and graininess is necessary, because fine details of the image are required for medical diagnosis. Currently, various hard copy systems utilizing pigments or dyes like inkjet printers and apparatus for electrophotography are prevailing to be general image-forming systems. However, there is no system satisfactory as a medical image-output system.

On the other hand, thermal image-forming systems utilizing an organic silver salt are described, for example, in U.S. Pat. Nos. 3,152,904 and 3,457,075, and D. Klosterboer, "Thermally Processed Silver Systems", *Imaging Processes and Materials,* Neblette 8th edition compiled by J. Sturge, V. Walworth and A. Shepp, Chapter 9, pp. 279, 1989. Generally, a heat-developable heat-sensitive material has a heat-sensitive layer in which a reducible silver salt (e.g., an organic silver salt), a reducing agent, and according to necessity a toner to control color tone of silver are dispersed in the matrix of binder. In contrast, a heat-developable photosensitive material generally has a photosensitive layer in which a photocatalyst (e.g., a silver halide) in a catalytically active amount, a reducing agent, a reducible silver salt (e.g., an organic silver salt), and according to necessity a toner to control color tone of silver are dispersed in the matrix of binder. The heat-developable photosensitive material is imagewise exposed to light, and then heated to a high temperature (e.g., 80° C. or more) to form a black silver image by a redox reaction between a reducible silver salt (acts as an oxidant) and the reducing agent. The redox reaction is accelerated by catalytic action of a latent image generated in a silver halide by exposure. Therefore, the black silver image is formed in an exposed area.

Regarding a support for these heat-developable recording material, supports having an undercoat layer containing a polyester resin are described in Japanese Patent Laid-Open No. 84574/1999. However, with supports having such an undercoat layer, it was found that problems occurred such as insufficient adhesion between a support and an image-forming layer, unevenness resulted in a coated surface condition or stripes generated in coating, and further repelling marks generated in coating of the image-forming layer.

As a matter of course, the material having such a repelling mark forms an image badly influenced. Accordingly, it has been desired to develop a support having an undercoat layer resulting in high productivity and without problems described in the above.

SUMMARY OF THE INVENTION

In consideration of these problems, the present invention has set an aim to provide a heat-developable recording material having an undercoat layer with which adhesion between the support and the image-forming layer is sufficient, unevenness in the coated surface condition in coating has been prevented, coating stripes have been improved, and further the problem of repelling marks generated in coating of the image-forming layer has been solved.

In the result of diligent investigations, the inventors have found that the coating stripes were caused by aggregates occurred in a coating process (in a coating die part) to make the surface condition worse. Further, the inventors have found that the repelling marks in coating a photosensitive layer were caused by foreign matters adhered to the surface of undercoat layer. When a photosensitive layer was coated on the surface where foreign matters had adhered, the photosensitive layer resulted in forming the repelling marks. Based on these analyzed factors, the inventors have discovered that a heat-developable recording material improved in the adhesive property and the coating property can be provided by using an undercoat layer having a specific composition to achieve the invention.

Namely, the invention provides a heat-developable recording material comprising a support, at least one undercoat layer and at least one image-forming layer, in this order, wherein the undercoat layer comprises:

polyester resins containing at least two kinds of water-soluble and water-dispersible polyester resins, each of which has a different glass transition temperature (Tg); and fine particles having an average particle diameter (k) of from 0.1 $\mu$m to 2.0 $\mu$m, and the undercoat layer has an average film thickness (d) of from 0.05 $\mu$m to 1.0 $\mu$m, and (k)/(d) is in the range from 2.0 to 10.0.

All of the polyester resins in the undercoat layer used in the invention are preferably a polyester resin without an acrylic-modification.

All of the polyester resins in the undercoat layer used in the invention preferably have a Tg of from 30° C. to 100° C.

Further, it is preferable that at least one of the polyester resins to be used in the invention is a polyester resin which fulfils Condition A:

the polyester resin has a Tg of from 40° C. to 100° C.;

an acid component of the polyester resin comprises: at least one of a terephthalic acid and isophthalic acid in a total amount of from 40 mol % to 90 mol %; and an isophthalic acid having a sulfonyloxy group below in an amount of from 10 mol % to 60 mol %: —$(SO_3)_nM$, wherein M represents a hydrogen atom, an alkali or alkali-earth metal, or a tertiary ammonium group; and an alcohol component of the polyester resin comprises a diethylene glycol in an amount of from 40 mol % to 90 mol % and a cyclohexane dimethanol in an amount of from 10 mol % to 60 mol %.

It is preferable that the polyester resins in the udercoat layer comprise: the polyester resin which satisfies Condition A in an amount of from 60 wt % to 90 wt %; and a polyester resin having a higher Tg than the polyester resin that satisfies Condition A in an amount of from 10 wt % to 40 wt %.

It is preferable that the undercoat layer contains the fine particles in an amount of from 0.1 wt % to 10 wt % in proportion to the amount of the polyester resin.

It is preferable that the image-forming layer in the invention comprises at least one kind of photosensitive silver halide, a non-photosensitive organic silver salt, a reducing agent for a silver ion and a binder.

DETAILED DESCRIPTION OF THE INVENTION

Detailed explanation regarding the heat-developable recording materials of the invention will be described hereinafter.

The heat-developable recording material of the invention comprises a support, at least one undercoat layer and at least one image-forming layer, in this order.

The heat-developable recording material of the invention preferably comprises a support, at least one undercoat layer on at least one surface side of the support and at least one image-forming layer on the undercoat layer.

The undercoat layer in the invention is characterized by containing polyester resins and fine particles, wherein the polyester resins are a mixture comprising two or more kinds of water-soluble or water-dispersible polyester resins having a different glass transition temperature (Tg), the fine particles have an average particle diameter (k) in the range from 0.1 $\mu$m to 2.0 $\mu$m, an average film thickness (d) of the undercoat layer is in the range from 0.05 $\mu$m to 1.0 $\mu$m, and (k)/(d) is in the range from 2.0 to 10.0.

The polyester resins to be used in the invention are a mixture of two or more kinds of water-soluble or water-dispersible polyester resins having a different glass transition temperature (Tg) as described in the above. The two or more kinds of polyester resins are preferably selected from polyester resins having a Tg in the range from 30° C. to 100° C., and more preferably from 40° C. to 98° C. In the invention, it is preferable that a polyester resin having a Tg in the range from 55° C. to 80° C. is contained at least in the range from 10 wt % to 100 wt %. Also, in the invention, the polyester resins preferably contain two kinds of the polyester resins in which the difference of Tg is 5° C. or more, more preferably 10° C. or more.

The water-soluble or water-dispersible polyester resin employable in the invention comprises a polymer including a structure of ester-bonding between a polyhydric alcohol and a polybasic acid within a molecular chain of the polymer manufactured by an optional method known in public. Examples of the polyhydric alcohol include ethylene glycol, propylene glycol, trimethylene glycol, 1,4-butanediol, cyclohexane-1,2-diol, cyclohexane-1,4-diol, neopentyl glycol, 1,6-hexanediol, 1,6-cyclohexane dimethanol, glycerin, trimethylolpropane, and an alkyleneoxyd adduct of bisphenol A. Also, examples of the polybasic acid include isophthalic acid, terephthalic acid, phthalic acid anhydride, 4-sulfophthalic acid, adipic acid, itaconic acid, fumaric acid, 2,6-naphthalenedicarboxylic acid, hexahydroterephthalic acid, 4,4'-diphenyldicarboxylic acid, phenylindane dicarboxylic acid, sebacic acid, sodium salt of 5-sulfoisophthalic acid, trimellitic acid and dimethylolpropionic acid.

In the invention, an aqueous polyester may be used as the polyester resin. Examples of the aqueous polyester include those in which the polyester resin described in the above has been subjected to emulsion polymerization to be an emulusion and those in which the polyester resin has been introduced with a hydrophilic group such as a carboxylic group and a sulfonic acid group to be hydrophilic. The aqueous polyester resins are classified as a water-soluble type, an emulsion dispersion type and a colloid dispersion type as an intermediate type between the former ones. In the invention, any type can be used in the undercoat layer. Examples of the aqueous polyester resin include those described in *Comprehensive Data Book of Water-Soluble High Molecular Water-Dispersion Type Resins,* Keiei Kaihatsu Senta (Management Development Center), 1981.

Any of the polyester resins mixed in the invention may be an acryl-modified one. However, it is preferable that all of them are selected from those without acrylic modification. When the polyester resins without acrylic modification are used, the undercoat layer having better adhesion can be formed (see TABLE 2 below), which is an aim of the invention.

In the heat-developable recording material of the invention, it is preferable to use at least one kind of polyester resin which fulfils Condition A described below.

Condition A:

the polyester resin having a Tg of from 40° C. to 100° C.;

the acid component comprising an amount in the range from 40 mol % to 90 mol % of terephthalic acid and/or isophthalic acid as a sum and an amount in the range from 10 mol % to 60 mol % of isophthalic acid having a sulfonyloxy group: —$(SO_3)_nM$ (wherein, M represents a hydrogen atom, an alkali or alkali-earth metal or a tertiary ammonium group); and the alcohol component comprising an amount in the range from 40 mol % to 90 mol % of diethylene glycol and an amount in the range from 10 mol % to 60 mol % of cyclohexane dimethanol.

The polyester resin which fulfils Condition A is a polymer including a structure of ester-bonding between a polyhydric alcohol and a polybasic acid. It is preferred to use an amount in the range from 65 mol % to 90 mol % of terephthalic acid and/or isophthalic acid as a sum, and an amount in the range from 10 mol % to 35 mol % of isophthalic acid having a sulfonyloxy group: —$(SO_3)_nM$, is used. As the polyhydric alcohol component, an amount in the range from 40 mol % to 75 mol % of diethylene glycol is preferably used. In the case, an amount in the range from 25 mol % to 60 mol % of cyclohexane dimethanol is used.

Such a polyester resin can also be synthesized by an optional method known in public. For example, the synthesis can be conducted by using an acid component and an alcohol component which are subjected to the known two-step manufacturing method, namely, esterification and polycondensation or ester-exchange and polycondensation starting from a free carboxylic acid. The isophthalic acid having a sulfonyloxy group: —$(SO_3)_nM$ is manufactured in a form that M is an alkali or alikali-earth metal or a tertiary ammonium group.

For the polyester resin having a different Tg mixed with the polyester resin which fulfils Condition A, it is preferred to use a polyester resin having a higher Tg compared to the Tg of the polyester resin which fulfils Condition A. Besides, the polyester resin mixed with the polyester resin which fulfils Condition A may or may not fulfil Condition A as far as it has a higher Tg compared to the Tg of the polyester resin which fulfils Condition A. Also, in the invention, the difference of Tg between the polyester resin which fulfils Condition A and the polyester resin mixed with the polyester resin that fulfils Condition A, is preferably 5° C. or more, more preferably 10° C. or more.

For a ratio of mixing these two or more kinds of polyesster resins, it is preferred that an amount in the range from 60 wt % to 90 wt % of the polyester resin which fulfils Condition A and an amount in the range from 10 wt % to 40 wt % of the polyester resin having a higher Tg compared to the former one are mixed. The more preferable ratio is 70 to 90 wt % of the former and 10 to 30 wt % of the latter.

Examples of the polyester resin to be used in the invention include the following compounds.

P-1. TPA/IPS//DEG/CHDM=90/10//70/30 (mol %) (Tg=55° C.)

P-2. IPA/IPS//DEG/CHDM=70/30//70/30 (mol %) (Tg=79° C.)

P-3. TPA/IPA/IPS//DEG/CHDM=40/40/20//40/60 (mol %) (Tg=73° C.)

P-4. TPA/IPS//DEG/CHDM=70/30//50/50 (mol %) (Tg=95° C.)

P-5. IPA/IPS//DEG/CHDM=85/15//55/45 (mol %) (Tg=53° C.)

P-6. TPA/IPA/IPS//EG=50/40/10//100 (mol %) (Tg=80° C.)

(Abbreviations in the above structures show the following monomers. TPA: terephthalic acid, IPA: isophthalic acid, IPS: sodium salt of sulfoisophthalic acid, EG: ethylene glycol, DEG: diethylene glycol, CHDM: cyclohexane dimethanol)

In the invention, the following materials available in the market can be utilized as the polyester resin empoyable in the undercoat layer.

Examples of the polyester resin include Vylon 200 (TPA/IPA//EG/NPG=50/50//50/50 mol %, Tg=67° C.), 300, Vylonal MD-1200 (Tg=67° C.), MD-1245 (Tg=61° C.), MD-1500 (these are manufactured by Toyobo Co., Ltd.) Finetex ES525, ES611, ES650, ES675 (Tg=35° C.) (these are manufactured by Dainippon Ink & Chemicals, Inc.), KP-1019, KP-1027, KP-1029 (these are manufactured by Matsumoto Yushi-Seiyaku Co. Ltd.), Pluscoat Z-446, 710, 711, 766, 770, 802, 857 (these are manufactured by Goo Chemical Co., Ltd.), Pesresin A123D, A-515GB (Tg=60° C.), A-510 (Tg=35° C.), and A-520 (Tg=52° C.) (these are manufactured by Takamatsu Oil & Fat Co. Ltd.).

(Abbreviation NPG in the above structure shows neopentyl glycol.)

A molecular weight of the polyester resins to be used in the invention is preferably in the range from 2,000 to 200,000 by weight average molecular weight (Mw).

The fine particles employable in the invention have an average particle diameter (k) in the range from 0.1 μm to 2.0 μm and preferably in the range from 0.2 μm to 1.0 μm.

The fine particles employable in the invention are preferably those made from unsaturated monomers by polymerization or copolymerization. Preferable examples of such an unsaturated monomer include styrene, α-methylstyrene, methylmethacrylate, methylacrylate, ethylacrylate, glycidylmethacrylate, acrylic acid, methacrylic acid, acrylonitrile and divinylbenzene.

For the particles employable in the invention, particles of styrene, polymethylmethacrylate and silica are more preferred.

An average film thickness (d) of the undercoat layer in the invention is in the range from 0.5 μm to 1.0 μm and preferably in the range from 0.05 μm to 0.5 μm.

In the invention, (k)/(d) is in the range from2.0to 10.0, and preferably in the range from 3.0 to 8.0.

In the invention, the particles are preferably contained as an amount from 0.1 wt % to 10 wt % in proportion to the amount of the polyester resin, and more preferably from 1 wt % to 5 wt %.

In the invention, the undercoat layer can be formed by coating an undercoat layer coating solution containing the polyester resins and the particles on a support, preferably on a polyester film.

To the undercoat layer, in addition to the components described in the above, another resin, a cross-linking agent, an anti-static agent, another organic or inorganic filler, a coloring agent, a surfactant and an ultra violet absorber can be added according to necessity.

For the cross-linking agent, known compounds such as epoxy, isocyanate and melamine are used. Active halogen cross-linking agents described in Japanese Patent Laid-Open No. 114120/1976 are also preferable.

Further, colloidal silica for the filler, anion, nonion and cation surfactants for the surfactant, and anti-halation dyes and color tone control dyes for the dye can be used.

A solid content concentration in the undercoat layer coating solution is preferably in the range from 0.1 wt % to 10 wt %, and more preferably in the range from 1 wt 5 to 5 wt %.

The undercoat layer may be formed by coating and drying a coating solution of either aqueous type or organic solvent type. Examples of the coating solvent include water, methanol, isopropyl alcohol, Butyl Cellosolve and dimethylformamide. In the invention, from the viewpoint of cost and the environment, aqueous type coating in which an aqueous coating solution is coated is preferable, wherein "an aqueous coating solution" means that the coating solution comprises 30 wt % or more of water in the entire solvents (dispersion media), and more preferably 50 wt % or more. In addition to water, specific examples of the solvent composition include the following mixed solutions: water/methanol=85/15, water/methanol=70/30, water/methanol/dimethylformamide (DMF)=80/15/5 and water/isopropyl alcohol=60/40 (wherein a group of numerals indicates a ratio by weight).

In the invention, a coating process and a drying process of the undercoat layer are not particularly limited. For the coating process, known methods such as a bar coater and a dipping coater can be used. For the drying process, a temperature in the range from 25° C. to 200° C. and a time in the range from 0.5 minutes to 20 minutes are preferred. Drying can be conducted under these conditions.

The undercoat layer containing the polyester resins which fulfil conditions of the invention may be provided as a single layer only or as two or more layers.

In the heat-developable recording material of the invention, in addition to the undercoat layer containing the polyester resins, an undercoat layer without the polyester resins maybe provided. For a binder in such an undercoat layer, gelatin as an example may be used. Also to this undercoat layer, a cross-linking agent, a matting agent, a dye, a filler and a surfactant as described in the above may be added according to necessity. A thickness of these undercoat layers is preferably in the range from 0.05 μm to 30 μm, and more preferably in the range from 0.08 μm to 30 μm.

The undercoat layer containing the polyester resins which fulfil conditions of the invention is provided as an under layer of the image-forming layer on the image-forming layer-side which is the surface for image-formation. For the purpose of improving adhesion to the support, it is preferred that the undercoat layer is provided directly on the support as a layer inserted between the support and the image-forming layer. In case of a both-sided heat-developable recording material having each image-forming layer on both sides of the support, it is preferable that the undercoat layers containing the polyester resins which fulfil conditions of the invention are provided on both sides of the support.

As the support employable in the invention, a transparent support is preferable and a transparent polyester support [e.g., polyethylene terephthalate (PET) or polyethylene naphthalate] is more preferable. Among transparent polyester supports, polyester, in particular, polyethylene terephthalate which has thermally been treated in the temperature range from 130° C. to 185° C. in order to relax the residual internal stress in the two axial stretching and to eliminate the stress of thermal contraction generated in heat development is preferably used. In case of heat-developable photosensitive materials for the medical use, the transparent support may be colored with blue dyes (e.g., Dye-1 described in Japanese Patent Laid-Open No. 240877/1996) or may not be colored. Further, for providing an anti-static layer to the support, techniques described in Japanese Patent Laid-Open No. 143430/1981, Japanese Patent Laid-Open No. 143431/1981, Japanese Patent Laid-Open No. 62646/1983, Japanese Patent Laid-Open No. 120519/1981, Japanese Patent Laid-Open No. 84573/1999, paragraphs [0040] to [0051], U.S. Pat. No. 5,575,957, and Japanese Patent Laid-Open No. 223898/1999, paragraphs [0078] to [0084] can be applied.

In the heat-developable recording material of the invention, it is preferable that a photo-insensitive organic silver salt, a reducing agent for this organic silver salt and a binder are contained. Further, it is preferable that a photosensitive silver salt is additionally contained to make a photosensitive layer. In case with the photosensitive layer, a heat-developable photosensitive material is obtained.

The photo-insensitive organic silver salt (hereinafter, it may simply be called as an organic silver salt) employable in the invention is relatively stable against light, but it is such a silver salt as to form a silver image when heated at 80° C. or more in the presence of a photocatalyst exposed to light (e.g., a latent image in a photosensitive silver halide) and a reducing agent. The organic silver salt maybe an arbitrary organic substance containing a source capable of reducing a silver ion. Such photo-insensitive organic silver salts are described in Japanese Patent Laid-Open No. 62899/1998, paragraphs [0048] to [0049], European Patent Laid-Open No. 0803764A1, pp. 18 line 24 to pp. 19 line 37, European Patent Laid-Open No. 0962812A1, Japanese Patent Laid-Open No. 349591/1999, Japanese Patent Laid-Open No. 7683/2000 and Japanese Patent Laid-Open No. 72711/2000. For the organic salt, a silver salt of an organic acid is preferable, and a silver salt having a long-chain (including 10 to 30 carbon atoms, preferably 15 to 28) aliphatic carboxylic acids is particularly preferable. Preferable examples of the organic silver salt include silver behenate, silver arachidate, silver stearate, silver oleate, silver laurylate, silver capronate, silver myristate, silver palmitate, and their mixture. In the invention, among these organic silver salts, it is preferable to use silver salts of organic acids having the silver behenate content ratio of 75 mol % or more.

A shape of the organic silver salt employable in the invention is not particularly restricted, but may be needle-shaped, rod-shaped, tabular or scaly.

In the invention, it is preferable to use a scaly organic silver salt. In the invention, the scaly organic silver salt is defined as follows. The organic acid silver salt is observed by means of an electronic microscope, and the shape of the organic acid silver salt particle is approximated to a rectangular parallelepiped. When the sides of the rectangular parallelepiped are taken as a, b and c in the order from the shortest (c may be equal to b), x is calculated from the shorter numerical values, a and b, as follows.

$$x=b/a$$

Thus, x is obtained from about 200 particles according to the above equation, and when the average value is taken as x (average), those particles satisfying the relationship: x (average)≧1.5, are regarded as scaly particles. The range, 30≧x (average)≧1.5, is preferable, and the range, 20≧x (average)≧2.0, is more preferable In this connection, needle-shaped particles satisfy the relation, 1.5>x (average) ≧1.

In a scaly particle, a can be regarded as a thickness of a tabular particle having a plane with sides of b and c as the main plane. The average of a is preferably in the range from 0.01 μm to 0.23 μm, and more preferably from 0.1 μm to 0.2 μm. The average of c/b is preferably in the range from 1 to 6, more preferably from 1.05 to 4, furthermore preferably from 1.1 to 3, and in particular, preferably from 1.1 to 2.

It is preferable that particle size distribution of the organic silver salt is monodispersed. Being monodispersed means that the values in terms of percentage obtained from each standard deviation of length of short axis and long axis divided by each length of short axis and long axis respectively are preferably 100% or less, more preferably 80% or less, and furthermore preferably 50% or less. The shape of the organic silver salt can be measured from transmission electron microscopic images of the organic silver salt dispersion. Another method of measuring monodispersity is to obtain the standard deviation of volume weighted average diameter of organic silver salt particles. The value in terms of percentage (variation coefficient) obtained from the standard deviation divided by the volume weighted average diameter is preferably 100% or less, more preferably 80% or less, and furthermore preferably 50% or less. As an example of the measurement method, monodispersity can be measured from a particle size (volume weighted average diameter) obtained by irradiating the organic silver salt particles dispersed in a liquid with laser beams and by finding the autocorrelation function to the time variation of fluctuation of the scattered light.

For manufacture methods and dispersion methods of the organic acid silver salts used in the invention, methods known in public can be applied. For example, the following references can be referred: Japanese Patent Laid-Open No. 62899/1998, European Patent Laid-Open No. 0803763A1, European Patent Laid-Open No. 0962812A1, Japanese Patent Laid-Open No. 349591/1999, Japanese Patent Laid-Open No. 7683/2000, Japanese Patent Laid-Open No. 72711/2000, Japanese Patent Application No. 348228 to 30/1999, Japanese Patent Application No. 203413/1999, Japanese Patent Application No. 90093/2000, Japanese Patent Application No. 195621/2000, Japanese Patent Application No. 191226/2000, Japanese Patent Application No. 213813/2000, Japanese Patent Application No. 214155/2000 and Japanese Patent Application No. 19122612000.

Because of fog increase and remarkable lowering of photosensitivity when a photosensitive silver salt coexists during dispersing the organic silver salt, it is more preferable that any photosensitive silver salt is not included substantially during dispersing. In the invention, the amount of a photosensitive silver salt in an aqueous dispersion to be dispersed is 0.1 mol % or less per 1 mol of the organic acid silver salt in the dispersion, and addition of the photosensitive silver salt is not positively conducted.

In the invention, it is possible to manufacture the photosensitive material by mixing an aqueous dispersion of the organic silver salt and an aqueous dispersion of the photosensitive silver salt. The mixing ratio of the photosensitive silver salt to the organic silver salt can be selected according to the purpose. A ratio of the photosensitive silver salt to the organic silver salt is preferably in the range from 1 mol % to 30 mol %, more preferably from 3 mol % to 20 mol %, and preferably in particular from 5 mol % to 15 mol %. In case of mixing, it is a method preferably used for adjusting photographic properties that two or more kinds of aqueous dispersions of organic silver salts and two or more kinds of aqueous dispersions of photosensitive silver salts are mixed.

In the invention, the organic silver salts can be used in any amount desired. The coated amount calculated in terms of silver is preferably in the range from 0.1 $g/m^2$ to 5 $g/m^2$, and more preferably from 1 $g/m^2$ to 3 $g/m^2$.

The heat-developable photosensitive material of the invention preferably includes a reducing agent for the organic silver salts. The reducing agent for the organic silver salts maybe an arbitrary substance (preferably an organic substance) which reduces a silver ion to metallic silver. Such reducing agents are described in Japanese Patent Laid-Open No. 65021/1999, paragraphs [0043] to [0045], and European Patent Laid-Open No. 0803764A1, pp. 7 line 34 to pp. 18 line 12.

For the reducing agent in the invention, a reducing agent in hindered phenols and a reducing agent in bisphenols are preferable. Compounds represented by General Formula (I) described below are more preferable.

General Formula (I):

(I)

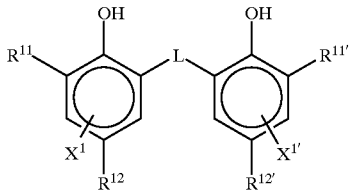

In General Formula (I), each of $R^{11}$ and $R^{11'}$ independently represents an alkyl group having 1 to 20 carbon atoms. Each of $R^{12}$ and $R^{12'}$ independently represents a hydrogen atom or a substituent capable of substituting on a benzene ring. Each of $X^1$ and $X^{1'}$ independently represents a hydrogen atom or a substituent capable of substituting on a benzene ring. $R^{11}$ and $X^1$, $R^{11'}$ and $X^{1'}$, $R^{12}$ and $X^1$, and $R^{12'}$ and $X^{1'}$ may form a ring by connecting each other. L represents an —S— group or a —$CHR^{13}$— group, and $R^{13}$ represents a hydrogen atom or an alkyl group having 1 to 20 carbon atoms.

In General Formula (I), each of $R^{11}$ and $R^{11'}$ independently represents an alkyl group having 1 to 20 carbon atoms, being substituted or non-substituted, and being a normal chain, a branched chain or a ring type. The substituent of the alkyl group is not particularly restricted, but preferably an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom.

Each of $R^{11}$ and $R^{11'}$ is more preferably a secondary or tertiary alkyl group having 3 to 15 carbon atoms, and specifically an isopropyl group, an isobutyl group, a tert-butyl group, a tert-amyl group, a tert-octyl group, a cyclohexyl group, a cyclopentyl group, a 1-methylcyclohexyl group, or a 1-methylcyclopropyl group. An alkyl group having 4 to 12 carbon atoms is furthermore preferable. Among these, a tert-butyl group, a tert-amyl group and a 1-methylcyclohexyl group are particularly preferable, and a tert-butyl group is the most preferable one.

Each of $R^{12}$ and $R^{12'}$ independently represents a hydrogen atom or a substituent capable of substituting on a benzene ring. Each of $X^1$ and $X^{1'}$ independently represents a hydrogen atom or a substituent capable of substituting on a benzene ring. For the substituent capable of substituting on a benzene ring, an alkyl group, an aryl group, a halogen atom, an alkoky group and an acylamino group are preferably mentioned. $R^{12}$ and $R^{12'}$ are preferably an alkyl group having 1 to 20 carbon atoms, and specifically a methyl group, an ethyl group, a propyl group, a butyl group, an isopropyl group, a tert-butyl group, a tert-amyl group, a cyclohexyl group, a 1-methylcyclohexyl group, a benzyl group, a methoxymethyl group, or a methoxyethyl group. A methyl group, an ethyl group, a propyl group, an isopropyl group, and a tert-butyl group are more preferable.

Each of $X^1$ and $X^{1'}$ is preferably a hydrogen atom, a halogen atom or an alkyl group, and preferably in particular a hydrogen atom.

$R^{11}$ and $X^1$, $R^{11'}$ and $X^{1'}$, $R^{12}$ and $X^1$, and $R^{12'}$ and $X^{1'}$ may form a ring by connecting each other. The ring is preferably a ring having 5 to 7 members, and more preferably a saturated ring having 6 members.

L represents an —S— group or a —$CHR^{13}$— group. $R^{13}$ is a hydrogen atom or an alkyl group having 1 to 20 carbon atoms. The alkyl group represented by $R^{13}$ may be any of a normal chain, a branched chain or a ring type, and may be substituted. The number of carbon atoms of an alkyl group represented by $R^{13}$ is preferably 1 to 15. Specific examples of a non-substituted alkyl group include a methyl group, an ethyl group, a propyl group, a butyl group, a heptyl group, an undecyl group, an isopropyl group, a 1-ethylpentyl group and a 2,4,4-trimethylpentyl group. The substituent of a substituted alkyl group represented by $R^{13}$ is the same as the substituent of a substituted alkyl group represented by $R^{11}$ and $R^{11'}$.

L represents an —S— group or a —$CHR^3$— group. L is preferably a —$CHR^{13}$— group.

$R^{13}$ is a hydrogen atom or an alkyl group having 1 to 20 carbon atoms. The alkyl group represented by $R^{13}$ may be any of a normal chain, a branched chain or a ring type, and may be substituted. The number of carbon atoms of an alkyl group represented by $R^{13}$ is preferably 1 to 15. Specific examples of a non-substituted alkyl group include a methyl group, an ethyl group, a propyl group, a butyl group, a heptyl group, an undecyl group, an isopropyl group, a 1-ethylpentyl group and a 2,4,4-trimethylpentyl group. For the substituent to an alkyl group, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, and a sulfamoyl group are mentioned. Preferable one for $R^{13}$ is a hydrogen atom, a methyl group, an ethyl group, a propyl group, an isopropyl group, or a 2,4,4-trimethylpentyl group. The particularly preferable one for $R^{13}$ is a hydrogen atom, a methyl group, an ethyl group, or a propyl group.

When $R^{13}$ is a hydrogen atom, each of $R^{12}$ and $R^{12'}$ is preferably an alkyl group having 2 to 5 carbon atoms, more preferably an ethyl group and a propyl group, and most preferably an ethyl group.

When $R^{13}$ is a primary or secondary alkyl group having 1 to 8 carbon atoms, each of $R^{12}$ and $R^{12'}$ is preferably a methyl group. For the primary or secondary alkyl group having 1 to 8 carbon atoms which can be represented by $R^{13}$, a methyl group, an ethyl group, a propyl group, and an isopropyl group are more preferable, and a methyl group, an ethyl group and a propyl group are furthermore preferable.

Specific examples of the compound represented by General Formula (I) are shown below. However, compounds employable in the invention are not construed as being limited by these examples.
(I-1)
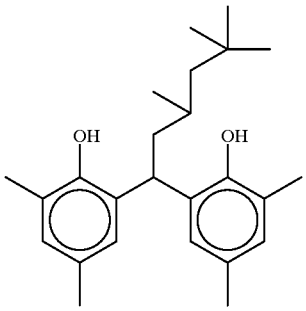
(I-2)
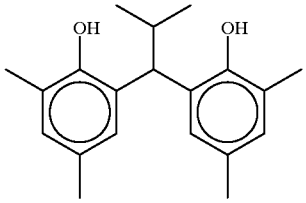
(I-3)
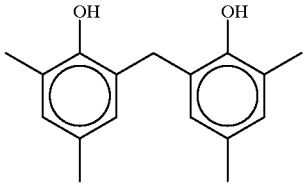
(I-4)
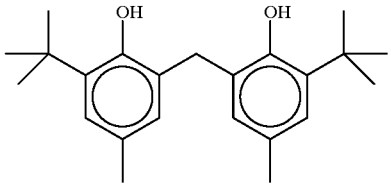
(I-5)
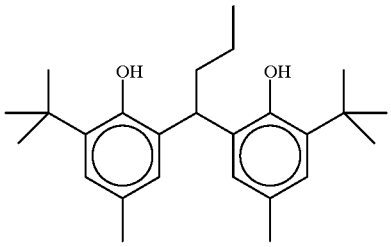
(I-6)
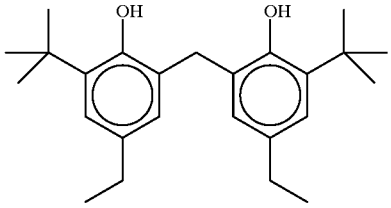
-continued
(I-7)
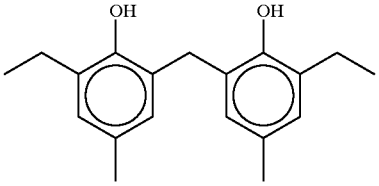
(I-8)
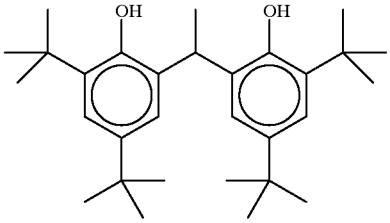
(I-9)
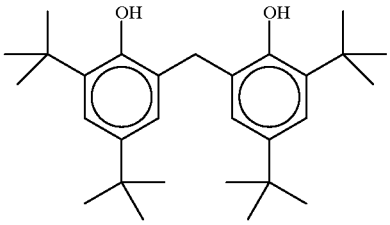
(I-10)
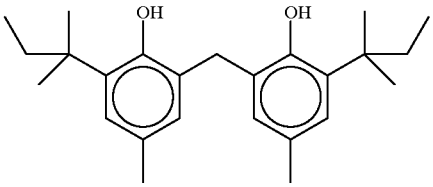
(I-11)
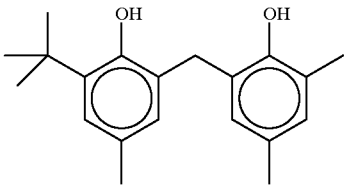
(I-12)
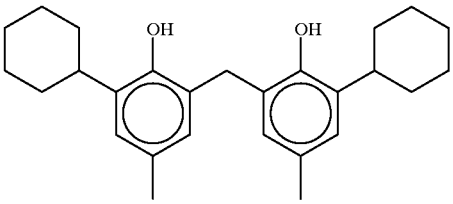
(I-13)
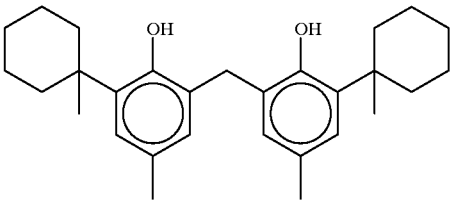

-continued
(I-14)
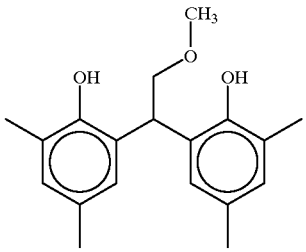
(I-15)
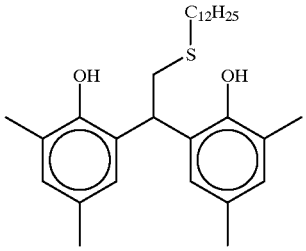
(I-16)
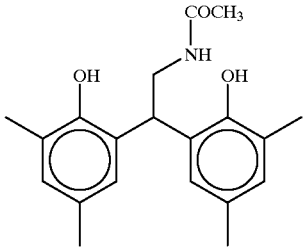
(I-17)
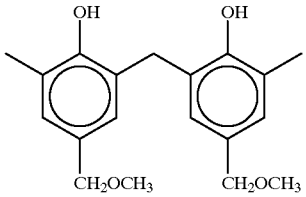
(I-18)
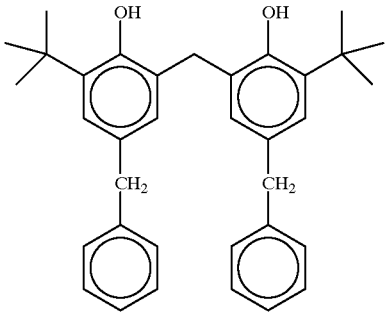
(I-19)
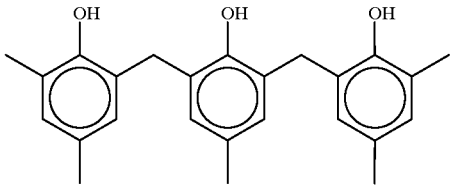
-continued
(I-20)
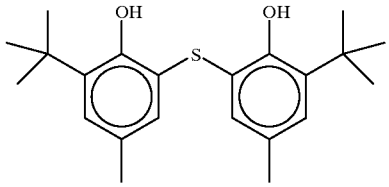
(I-21)
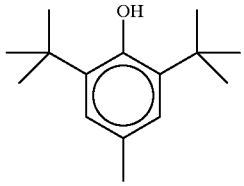
(I-22)
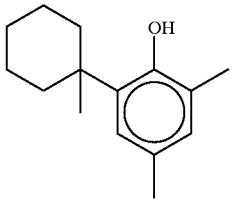
(I-23)
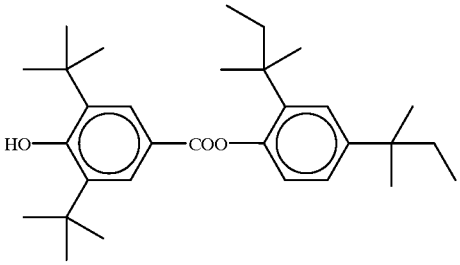
(I-24)
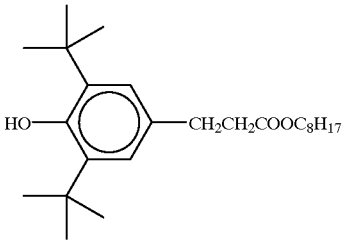
(I-25)
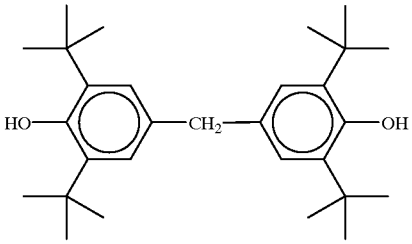

-continued (I-26)

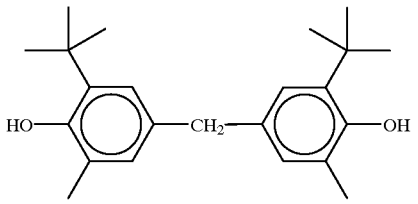

(I-27)

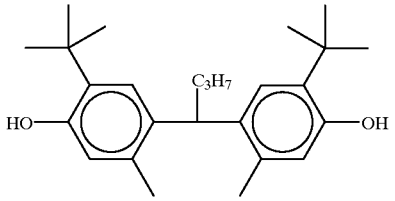

In the invention, an addition amount of the reducing agent is preferably in the range from 0.01 g/m$^2$ to 5.0 g/m$^2$, and more preferably from 0.1 g/m$^2$ to 3.0 g/m$^2$. It is preferable that the reducing agent of 5 mol % to 50 mol % is contained per 1 mol of silver on the surface having the image-forming layer, and it is more preferable that the reducing agent of 10 mol % to 40 mol % is contained. The reducing agent is preferably contained in the image-forming layer.

The reducing agent can be incorporated into the heat-developable photosensitive material by being contained in the coating solution with any method of using a solution form, an emulsified dispersion form, and a solid fine particle dispersion form.

As a well-known emulsified dispersion method, methods in which an emulsified dispersion is mechanically prepared by dissolving the reducing agent with oil such as dibutylphthalate, tricresyl phosphate, glyceryl triacetate or diethyl phthalate and with an auxiliary solvent such as ethyl acetate or cyclohexanone are mentioned.

Further, for a solid fine particle dispersion method, methods of preparing a solid dispersion by dispersing powder of the reducing agent into an appropriate solvent like water by means of a ball mill, a colloid mill, a vibration ball mill, a sand mill, a jet mill, a roller mill or an ultrasound wave unit are mentioned. In these cases, a protective colloid (e.g., polyvinyl alcohol) and a surfactant [an anionic surfactant like sodium tri-isopropylnaphthalene sulfonate (a mixture of those having three different positions substituted by an isopropyl group)] may be used. In an aqueous dispersion, an antiseptic agent (e.g., sodium benzoisothiazolinone) may be contained.

In the heat-developable photosensitive material of the invention, phenol derivatives represented by formula (A) described in Japanese Patent Application No. 73951/1999 are preferably used as a development accelerator.

When the reducing agent of the invention has an aromatic hydroxyl group (—OH), in particular in case of bisphenols described in the above, it is preferable to use a non-reducing compound having a group capable of forming a hydrogen bond with these groups in combination. The groups capable of forming a hydrogen bond with a hydroxyl group or an amono group include a phosphoryl group, a sulfoxide group, a sulfonyl group, a carbonyl group, an amide group, an ester group, a urethane group, a ureido group, a tertiary amino group and an aromatic group including nitrogen. Preferable compounds among these are a compound having a phosphoryl group, a sulfoxide group, an amide group [provided that it has not an >N—H group but is blocked like an >N—R$^a$ group (R$^a$ is a substituent except H)], a urethane group [provided that it has not an >N—H group but is blocked like an >N—R$^a$ group (R$^a$ is a substituent except H)], and a ureido group [provided that it has not an >N—H group but is blocked like an >N—R$^a$ group (R$^a$ is a substituent except H)].

In the invention, the particularly preferable one as the hydrogen bonding type compound is a compound represented by General Formula (II) shown below.

(II)

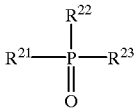

In General Formula (II), each of R$^{21}$, R$^{22}$ and R$^{23}$ independently represents an alkyl group, an aryl group, an alkoxy group, an aryloxy group, an amino group or a heterocyclic group. These groups may not contain or may contain a substituent. Two groups optionally selected from the groups of R$^{21}$, R$^{22}$ and R$^{23}$ may form a ring by connecting each other.

For the substituent when each of R$^{21}$, R$^{22}$ and R$^{23}$ has a substituent, a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group are mentioned. An alkyl group or an aryl group is preferable. Specific examples of the preferable substituent include a methyl group, an ethyl group, an isopropyl group, a tert-butyl group, a tert-octyl group, a phenyl group, a 4-alkoxyphenyl group and a 4-acyloxyphenyl group.

Specific examples of the group represented by R$^{21}$, R$^{22}$ and R$^{23}$ include a substituted or non-substituted alkyl group such as a methyl group, an ethyl group, a butyl group, an octyl group, a dodecyl group, an isopropyl group, a tert-butyl group, a tert-amyl group, a tert-octyl group, a cyclohexyl group, a 1-methylcyclohexyl group, a benzyl group, a phenetyl group and 2-phenoxypropyl group; a substituted or non-substituted aryl group such as a phenyl group, a cresyl group, a xylyl group, a naphthyl group, a 4-tert-butylphenyl group, a 4-tert-octylphenyl group, a 4-anisidyl group and a 3,5-dichlorophenyl group; a substituted or non-substituted alkoxyl group such as a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group; a substituted or non-substituted aryloxy group such as a phenoxy group, a cresyloxy group, an isopropylphenoxy group, a 4-tert-butylphenoxy group, a naphthoxy group and a biphenyloxy group; a substituted or non-substituted amino group such as an amino group, a dimethylamino group, a diethylamino group, a dibutylamino group, a dioctylamino group, an N-methyl-N-hexylamino group, a dicyclohexylamino group, a diphenylamino group and an N-methyl-N-phenylamino group; and a heterocyclic group such as a 2-pyridyl group, 4-pyridyl group, 2-franyl group, 4-piperidinyl group, 8-quinolyl group and 5-quinolyl group, Each of R$^{21}$, R$^{22}$ and R$^{23}$ is preferably an alkyl group, an aryl group, an alkoxy group or an aryloxy group. In consideration of the effects of the invention, it is preferable that one or more groups among R$^{21}$, R$^{22}$ and R$^{23}$ are alkyl groups or aryl groups. It is more preferable that two or more groups among $R^{21}$, $R^{22}$ and $R^{23}$ are alkyl groups or aryl groups. In the viewpoint of an advantage of purchasing at a low price, it is preferable that $R^{21}$, $R^{22}$ and $R^{23}$ are the same groups.

In the following, specific examples of the compound represented by General Formula (II) are indicated. Any compound possible to be used in the invention is, however, not construed as being limited by these specific examples.

(II-1)

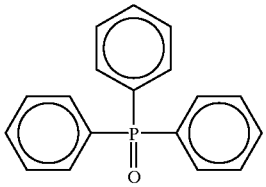

(II-2)

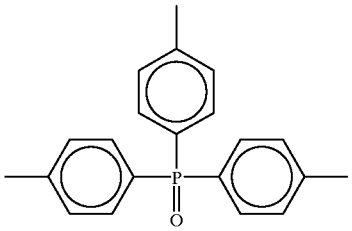

(II-3)

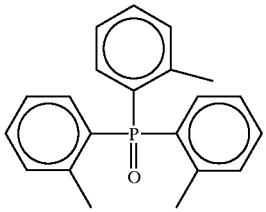

(II-4)

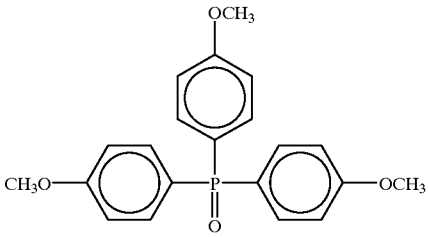

(II-5)

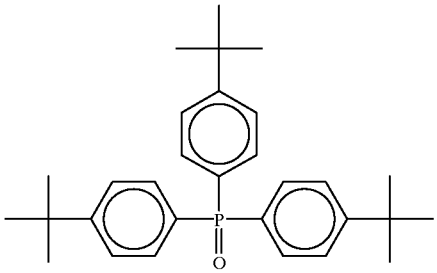

-continued (II-6)

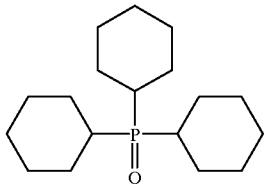

(II-7)

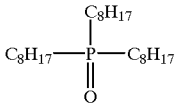

(II-8)

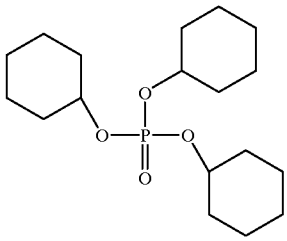

(II-9)

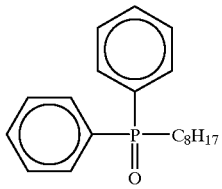

(II-10)

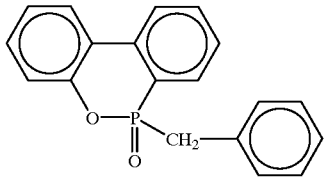

(II-11)

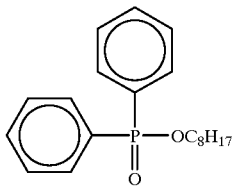

(II-12)

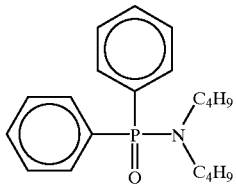

-continued (II-13)

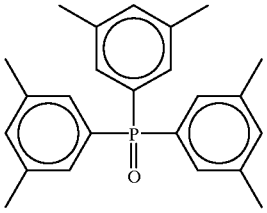

(II-14)

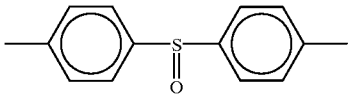

(II-15)

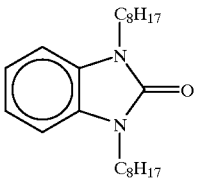

(II-16)

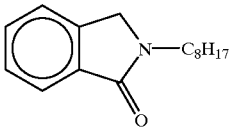

(II-17)

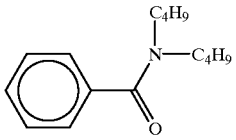

The compound represented by General Formula (II) can be used in the heat-developable photosensitive material by being incorporated into the coating solution in the same manner as that of the reducing agent, namely in a form of a solution, an emulsion dispersion or a solid dispersed fine particle dispersion. The compound represented by General Formula (II) forms a hydrogen-bonding complex with a compound having a phenolic hydroxyl group or an amino group in a solution state, so that it can be separated as a complex in a crystalline state, depending on a combination between the reducing agent and the compound represented by general Formula (II). It is particularly preferable for obtaining stable functions that thus separated crystal powder is used in the form of solid dispersed fine particle dispersion. Further, methods of mixing the reducing agent with the compound represented by General Formula (II) in a powder state, and then forming the complex during dispersing by means of a sand grinder mill with an appropriate dispersing agent can also preferably be used.

It is preferable that the compound represented by General Formula (II) is used in the range from 1 mol % to 200 mol % relative to the reducing agent, more preferable from 10 mol % to 150 mol % and furthermore preferable from 30 mol % to 100 mol %.

The halogen composition of a photosensitive silver halide used in the invention is not particularly limited. Silver chloride, silver chlorobromide, silver bromide, silver iodobromide and silver iodochlorobromide can be used. Among these, silver bromide and silver iodobromide are preferred. The distribution of halogen composition in a grain may be uniform, stepwise or continuously changed. Further, silver halide grains having a core/shell structure can preferably be used. For the structure, a twofold to fivefold structure is preferable. Core/shell grains having a twofold to fourfold structure are more preferably used. Techniques of localizing silver bromide on the grain surface of silver chloride or silver chlorobromide can also preferably be used.

Preparation methods of the photosensitive silver halide are well known to the industry. For example, methods described in Research Disclosure No. 17029, June 1978 and U.S. Pat. No. 3,700,458 can be used. Specifically, for preparing the photosensitive silver halide, a method is used in which silver-supplying compounds and halogen-supplying compounds are added into a solution containing gelatin or other polymers, and then the photosensitive silver halides obtained are mixed with the organic silver salts. Further, methods described in Japanese Patent Laid-Open No. 119374/1999, paragraphs [0217] to [0224], and methods described in Japanese Patent Application No. 98708/1999 and Japanese Patent Application No. 42336/2000 are also preferable.

A grain size of the photosensitive silver halide is preferably small for the purpose of suppressing a white turbidity after image formation to a low degree. Specifically, the grain size of 0.20 $\mu$m or less is preferable. The grain size in the range from 0.01 $\mu$m to 0.15 $\mu$m is more preferable, and from 0.02 $\mu$m to 0.12 $\mu$m is furthermore preferable. The grain size mentioned here means a diameter of a converted circular image having its area equivalent to a projection area of a silver halide grain (a projection area of the main plane in case of a tabular grain).

A shape of the silver halide grain maybe a cube, an octagon, a tabular grain, a spherical grain, a rod-shaped grain or a potato-shaped grain. In the invention, cubic grains are particularly preferable. Silver halide grains with rounded corners can also preferably be used. Face indices (Miller indices) of outer surfaces of photosensitive silver halide grains are not particularly limited. However, a higher ratio of {100} faces is preferable, because {100} faces exhibit a high efficiency of spectral sensitization when spectral sensitizing dyes have adsorbed. The ratio is preferably 50% or more, more preferably65% or more, and furthermore preferably 80% or more. The ratio of faces having the Miller index {100} can be obtained by a method of utilizing adsorption dependency between {111} faces and {100} faces in dye adsorption as described in T. Tani; *J. Imaging Sci.,* 29, pp. 165, 1985.

In the invention, it is preferable to use silver halide grains in the presence of a hexacyano metal complex on the outermost surface. The hexacyano metal complexes include $[Fe(CN)_6]^{4-}$, $[Fe(CN)_6]^{3-}$, $[Ru(CN)_6]^{4-}$, $[OS(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[RE(CN)_6]^{3}$. In the invention, hexacyano Fe complexes are preferred.

A counter cation of the hexacyano metal complex is not important because the hexacyano metal complex exists in an ionic form in an aqueous solution. However, it is preferable to use an alkali metal ion such as a sodium ion, a potassium ion, a rubidium ion, a cesium ion and a lithium ion, an ammonium ion, and an alkylammonium ion [e.g., a tetramethylammonium ion, a tetraethylammonium ion, a tetrapropylammonium ion and a tetra (n-butyl) ammonium ion], which are easily mixable with water and suitable for precipitation operation of a silver halide emulsion.

The hexacyano metal complex can be added as a mixture with water, an adequate organic solvent mixable with water (e.g., alcohols, ethers, glycols, ketones, esters, and amides), and gelatin.

The addition amount of the hexacyano metal complex is preferably in the range from $1\times10^{-5}$ mol to $1\times10^{-2}$ mol, and more preferably from $1\times10^{-4}$ mol to $1\times10^{-3}$ mol, per 1 mole of silver.

In order to make the hexacyano metal complex localized on the outermost surface of the silver halide grain, the hexacyano metal complex is directly added before finishing a grain formation process prior to a chemical sensitization process in which calcogen sensitization including sulfur sensitization, selenium sensitization and tellurium sensitization, and precious metal sensitization including gold sensitization and the like are performed, during a washing process, during a dispersion process, or before the chemical sensitization process. To inhibit the growth of silver halide grains, the hexacyano metal complex is preferably added as soon as possible after grain formation, and preferably before finishing the grain formation process.

Further, addition of the hexacyano metal complex may be started after addition of 96 wt % of the entire amount of silver nitrate being added for grain formation, preferably started after addition of 98 wt %, and preferably in particular started after addition of 99 wt %.

When these hexacyano metal complexes are added after addition of an aqueous solution of silver nitrate immediately before the completion of grain formation, molecules of the hexacyano metal complexe can adsorb on the outermost surface of silver halide grains and most of them form an insoluble salt with a silver ion on the grain surface. The silver salt of hexacyano Fe (II) is a more insoluble salt than AgI, so that it can prevent redissolving caused by fine grains. As a result, it has become possible to manufacture silver halide fine grains having small grain sizes.

The photosensitive silver halide grains to be used in the invention may contain a metal or a metal complex belonging to the groups 8 to 10 in the periodical table (showing the groups 1 to 18). As a central metal in the metal complex belonging to the groups 8 to 10 in the periodical table, the preferable one is rhodium, ruthenium or iridium. These metal complexes may be used as one kind, or two or more kinds of complexes having the same metal or different metals simultaneously in combination. A preferable content ratio of these metal complexes is in the range from $1\times10^{-9}$ mol to $1\times10^{-3}$ mol. These heavy metals and their complexes, and addition methods thereof are described in Japanese Patent Laid-Open No. 225449/1995, Japanese Patent Laid-Open No. 65021/1999, paragraphs [0018] to [0024] and Japanese Patent Laid-Open No. 119374/1999, paragraphs [0227] to [0240].

Further, metal atoms (e.g., $[Fe(CN)_6]^{4-}$) possible to be incorporated in the silver halide grains to be used in the invention, desalting methods and chemical sensitization methods for a silver halide emulsion are described in Japanese Patent Laid-Open No. 84574/1999, paragraphs [0046] to [0050], Japanese Patent Laid-Open No. 65021/1999, paragraphs [0025] to [0031], and Japanese Patent Laid-Open No. 119374/1999, paragraphs [0242] to [0250].

Various kinds of gelatin can be used for the gelatin contained in the photosensitive silver halide emulsion to be used in the invention. In order to maintain an excellent dispersion state of the photosensitive silver halide emulsion in a coating solution containing organic silver salts, it is preferable to use low molecular weight gelatin in the molecular weight range from500 to 60,000. The low molecular weight gelatin may be used in a grain formation stage or during dispersing after a desalting treatment. It is preferable to use the low molecular weight gelatin during dispersing after the desalting treatment.

For a sensitizing dye applicable to the invention, it is possible with advantages to select a dye which spectrally sensitizes a silver halide grain in a desired wavelength region and has a spectral sensitivity fitted to the spectral characteristics of a light source for exposure when the dye has adsorbed on a silver halide grain. Concerning the sensitizing dyes and addition methods thereof, the followings can be referred: paragraphs [0103] to [0109] of Japanese Patent Laid-Open No. 65021/1999, compounds represented by General Formula (II) of Japanese Patent Laid-Open No. 186572/1998, compounds represented by General Formula (I) and paragraph [0106] of Japanese Patent Laid-Open No. 119374/1999, U.S. Pat. No. 5,510,236, dyes described in Example 5 of U.S. Pat. No. 3,871,887, Japanese Patent Laid-Open No. 96131/1990, dyes disclosed in Japanese Patent Laid-Open No. 48753/1984, pp. 19 line 38 to pp. 20 line 35 of European Patent Laid-Open No. 0803764A1, Japanese Patent Application No. 86865/2000, Japanese Patent Application No. 102560/2000 and Japanese Patent Application No. 205399/2000/2000. These sensitizing dyes may be used as one kind or in combination of two or more kinds. In the invention, the time of adding the sensitizing dye into the silver halide emulsion is preferably in the period after a desalting process and before coating, and more preferably in the period after the desalting process and before the start of chemical ripening.

An addition amount of the sensitizing dye in the invention can be a desired amount corresponding to properties of fog and photosensitivity. The addition amount of the sensitizing dye is preferably in the range from $10^{-6}$ mol to 1 mol per 1 mol of silver halides in the image-forming layer, and more preferably from $10^{-4}$ mol to $10^{-1}$ mol.

In the invention, a supersensitizing agent can be used for improving the spectral sensitization efficiency. For the supersensitizing agent to be used in the invention, compounds described in European Patent Laid-Open No. 587, 338A, U.S. Pat. No. 3,877,943, U.S. Pat. No. 4,873,184, Japanese patent Laid-Open No. 341432/1993, Japanese patent Laid-Open No. 109547/1999, and Japanese patent Laid-Open No. 111543/1998 are cited.

It is preferable that the photosensitive silver halide grains in the invention are chemically sensitized in a sulfur sensitization method, a selenium sensitization method or a tellurium sensitization method. For a compound preferably used in the sulfur sensitization method, the selenium sensitization method or the tellurium sensitization method, compounds known in public, for example, compounds described in Japanese Patent Laid-Open No. 128768/1995 can be used. Particularly in the invention, the tellurium sensitization is preferable, and compounds described in the references cited in paragraph [0030] of Japanese Patent Laid-Open No. 65021/1999 and compounds represented by General Formula (II), (III) and (IV) of Japanese Patent Laid-Open No. 313284/1993 are more preferable.

In the invention, the chemical sensitization is possibly conducted in any period after grain formation and before coating. The conceivable periods are after desalting, (1) before spectral sensitizations (2) simultaneously with spectral sensitization, (3) after spectral sensitization, and (4) immediately before coatings. It is particularly preferable that the chemical sensitization is performed after spectral sensitization.

A use amount of a sulfur, selenium or tellurium sensitizer in the invention may vary according to the silver halide grains used and the conditions of chemical ripening. The use amount of the chemical sensitizer is approximately in the range from $10^{-8}$ mol to $10^{-2}$ mol, and preferably from $10^{-7}$ mol to $10^{-3}$ mol. The conditions of chemical sensitization in the invention are not particularly restricted. Approximately, such conditions as a pH from 5 to 8, a pAg from 6 to 11, and a temperature from 40° C. to 95° C. are used.

To the silver halide emulsion to be used in the invention, thiosulfonic acid compounds may be added according to methods indicated in European Patent Laid-Open No. 293, 917A.

The photosensitive silver halide emulsion in the photosensitive material used in the invention may be one kind, or two or more kinds (e.g., of different average grain sizes, different halogen compositions, different crystal habits and different conditions of chemical sensitization) in combination. Gradation can be adjusted by using plural kinds of photosensitive silver halide emulsions having different levels of photosensitivity. For techniques concerning these matters, techniques described in Japanese Patent Laid-Open No. 119341/1982, Japanese Patent Laid-Open No. 106125/1978, Japanese Patent Laid-Open No. 3929/1972, Japanese Patent Laid-Open No. 55730/1973, Japanese Patent Laid-Open No. 5187/1971, Japanese Patent Laid-Open No. 73627/1975 and Japanese Patent Laid-Open No. 150841/1982 are cited. It is preferable that a difference of photosensitivity in an extent of 0.2 log E or more is given to each emulsion.

An addition amount of the photosensitive silver halide is preferably in the range from0.03g/$m^2$to 0.6 g/$m^2$ as calculated in terms of a coated silver amount per 1 $m^2$ of the photosensitive material, more preferably in the range from 0.05 g/$M^2$ to 0.4 g/$m^2$, and most preferably in the range from 0.07 g/$m^2$ to 0.3 g/$m^2$. Per 1 mol of the organic silver salt, the amount of the photosensitive silver halide is preferably in the range from 0.01 mol to 0.5 mol, and more preferably from 0.02 mol to 0.3 mol.

Mixing methods and mixing conditions of the photosensitive silver halide and the organic silver salt prepared separately and respectively include methods in which the photosensitive silver halide and the organic silver salt respectively finished in preparation are mixed together by means of a high speed mixer, a ball mill, a sand mill, a colloid mill, a vibration mill or a homogenizer, and methods in which the organic silver salt is prepared by mixing the photosensitive silver halide finished in preparation at a certain time during preparation of the organic silver salt. However, the mixing methods and mixing conditions of the photosensitive silver halide and the organic silver salt are not particularly restricted so far as the effects of the invention are sufficiently revealed. Further, in mixing, it is a preferable method for adjusting photographic properties that two or more kinds of organic silver salt aqueous dispersions and two or more kinds of photosensitive silver salt aqueous dispersions are mixed.

A preferable addition period of the silver halide into the image-forming layer coating solution is from 180 minutes before coating to immediately before coating, and preferably from 60 minutes before coating to 10 seconds before coating. The mixing methods and mixing conditions are not particularly restricted so far as the effects of the invention are sufficiently revealed. Specific examples of the mixing method include a method of mixing in a tank which has an average staying time calculated from an addition flow rate and a feeding rate to a coating die adjusted to be a desired time, and a method of using a static mixer as described in N. Harnby, M. F. Edwards and A. W. Nienow, *Liquid Mixing Techniques*, translated by Koji Takahashi, Nikkan Kogyo Newspaper, Chapter 8, 1989.

The binder in the organic silver salt-containing layer maybe any of polymers. Preferable binders, which are transparent or semi-transparent and generally colorless, include natural resins or polymers and copolymers, synthetic resins or polymers and copolymers, and other media which form a film, for example, gelatins, rubbers, poly(vinyl alcohol)s, hydoxyethyl celluloses, cellulose acetates, cellulose acetate butylates, poly(vinylpyrrolidone)s, casein, starch, poly(acrylic acid)s, poly(methylmethacrylic acid)s, poly(vinyl chloride)s, poly(methacrylic acid)s, styrene/maleic acid anhydride copolymers, styrene/acrylonitrile copolymers, styrene/butadiene copolymers, poly(vinyl acetal) (e.g., poly(vinyl formal) and poly(vinyl butylal)], poly(ester)s, poly(urethane)s, phenoxy resins, poly (vinylidene chloride)s, poly(epoxide)s, poly(carbonate)s, poly(vinyl acetate)s, poly(olefin)s, cellulose esters and poly (amide)s. The binders may be formed as a film by coating a solution with water or an organic solvent or an emulsion.

In the invention, a glass transition temperature of the binder in the organic silver salt-containing layer is preferably in the range from 10° C. to 80° C. (hereinafter, such a binder may be called as a high Tg binder), more preferably in the range from 20° C. to 70° C., and furthermore preferably in the range from 23° C. to 65° C.

Besides, in the invention, the Tg was calculated with the following equation.

$$1/Tg=\Sigma(Xi/Tgi)$$

In this case, it is assumed that the polymer is formed by copolymerization of n monomer components from i=1 to i=n. Xi is the weight ratio of the i-th monomer ($\Sigma Xi=1$) and Tgi is a glass transition temperature (at an absolute temperature) of a homopolymer of the i-th monomer, provided that $\Sigma$ is the sum from i=1 to i=n. For the value (Tgi) of glass transition temperature of a homopolymer made from each monomer, values described in J. Brandrup and E. H. Immergut, *Polymer Handbook,* $3^{rd}$ Edition, Willey-interscience, 1989, have been adopted.

These polymers may be used as a single kinds or in combination of two or more kinds according to necessity. A combination of a polymer having Tg of 20° C. or more and a polymer having Tg lower than 20° C. may also be used. When two or more kinds of polymers having different Tg values are used in blending, it is preferable that a weight average Tg is in the range described in the above.

In the invention, properties of the heat-developable photosensitive material is improved when the organic silver salt-containing layer has been formed by coating a coating solution comprising 30 wt % or more of water of the total solvent and by drying, further when the binder in the organic solver salt-containing layer is soluble or dispersible in an aqueous solvent (a water solvent), and, in particular, when the binder comprises a latex of polymer the equilibrium moisture content of which at the temperature of 25° C. and the relative humidity of 60% is 2 wt % or less. The most preferable form is such that prepared so as to obtain an ionic Conductivity of 2.5 mS/cm or less. For such a preparation method, purification treatment methods using a functional membrane for separation after synthesizing a polymer are mentioned.

The aqueous solvent mentioned here in which the polymer is soluble or dispersible means water or a mixture of water and a water-mixable organic solvent in an amount of 70 wt % or less. As the organic solvent mixable with water, for example, an alcohol type solvent such as methyl alcohol, ethyl alcohol and isopropyl alcohol, a Cellosolve type solvent such as Methyl Cellosolve, Ethyl Cellosolve and Butyl Cellosolve, ethyl acetate and dimethyl formamide can be mentioned.

Besides, the words of "the aqueous solvent" is used even in case of a system where a polymer is not thermodynamically dissolved but exists in the so-called dispersed state.

"The equilibrium moisture content at 25° C. and 60% of relative humidity" can be expressed by using the weight W1 of a polymer in an equilibrium with moisture conditioning under the atmosphere of 25° C. and 60% of relative humidity and the weight W0 of the polymer in the absolutely dry state, as shown in the following equation.

The equilibrium moisture content at 25° C. and 60% of relative humidity=$\{(W1-W0)/W0\}\times 100$ (wt %)

Regarding the definition and the measurement method of moisture content, for example, *Testing Methods of Polymer Materials, Polymer Engineering Course* 14, compiled by the Society of Polymer Science of Japan, Chijin Shokan (Publishing) can be referred.

An equilibrium moisture content of the binder polymer to be used in the invention at 25° C. and 60% of relative humidity is preferably 2 wt % or less, more preferably in the range from 0.01 wt % to 1.5 wt %, and furthermore preferably in the range from 0.02 wt % to 1 wt %.

In the invention, a polymer dispersible in an aqueous solvent is particularly preferred. Examples of a dispersed state include a latex in which fine particles of a water-insoluble and hydrophobic polymer are dispersed and a dispersion in which polymer molecules are dispersed in a molecular state or a micelle-forming state. Both of them are preferable. An average particle diameter of dispersed particles is preferably in the range from 1 nm to 50,000 nm, and more preferably in the range approximately from 5 nm to 1,000 nm. A particle diameter distribution of the dispersed particles is not Specially limited. Either of dispersed particles having a broad particle diameter distribution or having a monodispersed particle diameter distribution may be used.

In the invention, for the preferable type of polymer dispersible in an aqueous solvent, hydrophobic polymers such as acryl type polymers, poly(ester)s, rubbers (e.g., SBR resins), poly(urethane)s, poly(vinyl chloride)s, poly(vinyl acetate)s, poly(vinylidene chloride)s and poly(olefin)s can preferably be used, These polymers may have a normal chain or a branched chain, and may be a cross-linked polymer, the so-called homopolymer polymerized with a single kind of monomers or a copolymer polymerized with two or more kinds of monomers. In case of a copolymer, it may be either of a random copolymer or a block copolymer. A molecular weight of these polymers is ranging from 5,000 to 1,000,000 in terms of the number average molecular weight, and preferably from 10,000 to 200,000. When a polymer having a too small molecular weight is used, mechanical strength of the emulsion layer (an image-forming layer) becomes insufficient. When a polymer having a too large molecular weight is used, coating properties to make a film turn worse. Both of these cases are not preferable.

Specific examples of a preferable latex for the binder of the organic silver salt-containing layer include the following materials. In the following, a material is expressed by using a starting monomer, a value in a parenthesis indicates a weight percentage and a molecular weight means a number average molecular weight. In case that multi-functional monomers have been used, the concept of molecular weight can not be applied, since cross-linked structures are formed. Accordingly, such a case is marked as "cross-linking" to omit description of molecular weight. A Tg means a glass transition temperature.

P-1; a latex (MW 37,000) of MMA(70)/EA(27)/MAA(3)

P-2; a latex (MW 40,000) of MMA(70)/2EHA(20)/St(5)/AA(5)

P-3; a latex (cross-linking) of St(50)/Bu(47)/MAA(3)

P-4; a latex (cross-linking) of St(68)/Bu(29)/AA(3)

P-5; a latex (cross-linking, Tg:24° C.) of St(71)/Bu(26)/AA(3)

P-6; a latex (cross-linking ) of St( 70)/ Bu(27)/IA(3)

P-7; a latex (cross-linking) of St(75)/Bu(24)/AA(1)

P-8; a latex (cross-linking) of St(60)/Bu(35)/DVB(3)/MAA(2)

P-9; a latex (cross-linking) of St(70)/Bu(25)/DVB(2)/AA(3)

P-10; a latex (MW 80,000) of VC(50)/MMA(20)/EA(20)/AN(5)/AA(5)

P-11; a latex (MW 67,000) of VDC(85)/MMA(5)/EA(5)/MAA(5)

P-12; a latex (MW 12,000) of Et(90)/MAA(10)

P-13; a latex (MW 130,000) of St(70)/2EHA(27)/AA(3)

P-14; a latex (MW 33,000) of MMA(63)/EA(35)/AA(2)

P-15; a latex (cross-linking, Tg:23° C.) of St(70.5)/Bu(26.5)/AA(3)

P-16; a latex (cross-linking, Tg:20.5° C.) of St(69.5)/Bu(27.5)/AA(3)

Abbreviations in the above structures show the following monomers. MMA; methyl metacrylate, EA; ethy acrylate, MAA methacylic acid, 2EHA; 2-ethylhexyl acrylate, St; Styrene, Bu; Butadiene, AA; acrylic acid, DVB; divinyl benzene, VC; vinyl chloride, AN; acrylonitrile, VDC; vinylidene chloride, Et; ethylene, and IA; itaconic acid.

Polymer latexes described in the above are sold in the market and products such as the followings can be available. Examples of acryl type polymers include Cevian A-4635, 4718 and 4601 (these are manufactured by Daicel Chemical Industries, Ltd.) and Nipol Lx811, 814, 821, 820 and 857 (these are manufactured by Zeon Corp.). Examples of poly (ester)s include FINETEX ES650, 611, 675 and 850 (these are manufactured by Dainippon Ink & Chemicals Inc.) and WD-size and WM5 (these are manufactured by Eastman Chemical Company). Examples of poly (urethane)s include HYDRAN AP10, 20, 30 and 40 (these are manufactured by Dainippon Ink & Chemicals Inc.). Examples of rubbers include LACSTAR 7310K, 3307B, 4700H and 7132C (these are manufactured by Dainippon Ink & Chemicals Inc.) and Nipol Lx416, 410, 438C and 2507 (these are manufactured by ZeonCorp.) Examples of poly(vinyl chloride)s include G351 and G576 (these are manufactured by Zeon Corp.). Examples of poly(vinylidene chloride)s include L502 and L513 (these are manufactured by Asahi Chemical Industry Co., Ltd.). Examples of poly (olefin)s include Chemipearl S120 and SA100 (these are manufactured by Mitsui Petrochemical Industries, Ltd.).

These polymer latexes may be used as a single kind or as a blend of two or more kinds according to necessity.

For the polymer latex used in the invention, in particular, a latex of a styrene/butadiene copolymer is preferred. It is preferable that a weight ratio of styrene monomer units to butadiene monomer units is in the range from 40:60 to 95:5. Further, it is preferable that a ratio of styrene monomer units together with butadiene monomer units in the copolymer is in the range from 60 wt % to 99wt %. The range of preferable molecular weight is the same as that described in the above.

For the latex of a styrene/butadiene copolymer preferably used in the invention, those from P-3 to P-8, P-14 and P-15 described in the above, and LACSTAR-3307B, 7132C and Nipol Lx416 as products available in the market are mentioned.

To the organic silver salt-containing layer (namely, the image-forming layer) of the heat-developable photosensitive material in the invention, hydrophilic polymers suchas gelatin, polyvinyl alcohol, methyl cellulose, hydroxypropyl cellulose and carboxymethyl cellulose maybe added according to necessity. An addition amount of these hydrophilic polymers is preferably 30 wt % or less of the total binder amount in the organic silver salt-containing layer, and more preferably 20 wt % or less.

The organic silver salt-containing layer formed by using the polymer latex is preferred. Regarding an amount of the binder in the organic silver salt-containing layer, a weight ratio of the total binder/organic silver salt is preferably in the range from 1/10 to 10/1, and more preferably from 1/5 to 4/1.

Further, the organic silver salt-containing layer like this usually acts as a photosensitive layer (an emulsion layer) in which a photosensitive silver halide is contained as a photosensitive silver salt. In such a case, a weight ratio of the total binder/silver halide is preferably in the range from 5 to 400, and more preferably from 10 to 200.

The total binder amount of the image-forming layer in the invention is preferably in the range from 0.2 $g/m^2$ to 30 $g/m^2$, and more preferably from 1 $g/m^2$ to 15 $g/m^2$. To the image-forming layer, a cross-linking agent for cross-linking and a surfactant for improving coating properties may be added.

In the invention, a solvent (for simplification here, both of a solvent and a dispersion medium are together expressed as a solvent) of an organic silver salt-containing layer coating solution for the photosensitive material is preferably an aqueous solvent including 30 wt % or more of water. As a component in addition to water, an optional water-mixable organic solvent such as methyl alcohol, ethyl alcohol, isopropyl alcohol, Methyl Cellosolve, Ethyl Cellosolve, dimethyl formamide and ethyl acetate may be used. A water content of the solvent of the coating solution is preferably 50 wt % or more, and more preferably 70 wt % or more. Examples of a preferable solvent composition include water/methyl alcohol=90/10, water/methyl alcohol=70/30, water/methyl alcohol/dimethyl formamide=80/15/5, water/methyl alcohol/Ethyl Cellosolve =85/10/5 and water/methyl alcohol/isopropyl alcohol=85/10/5 in addition to water (numerical values indicate a weight %).

For antifoggants, stabilizers and stabilizer precursors employable in the invention, compounds described in Japanese Patent Laid-Open No. 62899/1998, paragraph [0070], those disclosed in patents cited in European Patent Laid-Open No. 0803764A1, pp. 20 line 57 to pp. 21 line 7, and compounds described in Japanese Patent Laid-Open No. 281637/1997 and Japanese Patent Laid-Open No. 329864/1997 are mentioned. Further, the antifoggants preferably used in the invention are organic halides. For these antifoggants, compounds disclosed in patents described in Japanese Patent Laid-Open No. 65021/1999, paragraphs [0111] to [0112] are cited. Organic halogen compounds represented by Formula (P) in Japanese Patent Application No. 87297/1999, organic polyhalogen compounds represented by General Formula (II) in Japanese Patent Laid-Open No. 339934/1998 and organic polyhalogen compounds described in Japanese Patent Application No. 205330/1999 are particularly preferred.

The preferable polyhalogen compounds in the invention are specifically explained in the following. The preferable polyhalogen compounds of the invention are the compounds represented by General Formula (III) shown below. General Formula (III):

$$Q-(Y)n-C(Z^1)(Z^2)X$$

In General Formula (III), Q represents an alkyl group, an aryl group or a heterocyclic group, which may have a substituent, Y represents a divalent bonding group, n represents 0 or 1, each of $Z^1$ and $Z^2$ represents a halogen atom, and X represents a hydrogen atom or an electron-pulling group.

The alkyl group represented by Q may have a substituent. Any substituent can be used so far as the substituent gives no harmful influence to photographic properties. Examples of the substituent include a halogen atom (a fluorine atom, a chlorine atom, a bromine atom or an iodine atom), an alkyl group, an alkenyl group, analkynyl group, an aryl group, a heterocyclic group (including an N-substituted heterocyclic group having nitrogen, e.g., a morpholino group), an alkoxycarbonyl group, an aryloxycarbonyl group, a carbamoyl group, an imino group, an imino group substituted at the N atom, a thiocarbonyl group, a carbazoyl group, a cyano group, a thiocarbamoyl group, an alkoxy group, an aryloxy group, a heterocyclicoxy group, an acyloxy group, an (alkoxy or aryloxy) carbonyloxy group, a sulfonyloxy group, an acylamide group, a sulfonamide group, a ureido group, a thioureido group, an imido group, an (alkoxy or aryloxy) carbonylamino group, a sulfamoylamino group, a semicarbazide group, a thiosemicarbazide group, an (alkyl or an aryl) sulfonylureido group, a nitro group, an (alkyl or an aryl) sulfonyl group, a sulfamoyl group, a group having a structure of phosphoric acid amide or phosphoric acid ester, a silyl group, a carboxyl group or its salt, a sulfo group or its salt, a phosphoric acid group, a hydroxy group an a tertiary ammonium group. These substituents may further be sustituted by these substituents.

The aryl group represented by Q in General Formula (III) is an aryl group of a single ring or a condensed ring preferably having from 6 to 20 carbon atoms, more preferably having from 6 to 16 carbon atoms, and preferably in particular having from 6 to 10 carbon atoms. A phenyl group or a naphthyl group is preferred.

In General Formula (III), Q represents a phenyl group substituted by an electron-pulling group in which preferably the Hammet's substituent constant $\sigma_p$ has a positive value. Regarding the Hammet's substituent constant, *Journal of Medicinal Chemistry,* 1973, Vol. 16, No. 11, pp. 1207 to 1216 can be referred. Examples of such an electron-pulling group include a halogen atom [e.g., a fluorine atom (the σp value: 0.06), a chlorine atom (the σp value: 0.23), a bromine atom (the σp value: 0.23) and a iodine atom (the σp value: 0.18)], a trihalomethyl group [e.g., a tribromomethyl group (the σp value: 0.29) and a trichloromethyl group (the σp value: 0.33) and a trifluoromethyl group (the σp value: 0.54)], a cyano group (the σp value: 0.66), a nitro group (the σp value: 0.78), an aliphatic, aryl or heterocyclic sulfonyl group [e.g., a methane sulfonyl group (the σp value: 0.72)], an aliphatic, aryl or heterocyclic acyl group [e.g., an acetyl group (the σp value: 0.50) and a benzoyl group (the σp value: 0.43)], an alkynyl group [e.g., C≡CH (the σp value: 0.23)], an aliphatic, aryl or heterocyclic oxycarbonyl group [e.g., a methoxycarbonyl group (the σp value: 0.45) and a phenoxycarbonyl group (the σp value; 0.44)], a carbamoyl group (the σp value: 0.36), a sulfamoyl group (the σp value: 0.57), a sulfoxydo group, a heterocyclic group and a phosphoryl group. A σp value is preferably in the range from 0.2 to 2.0, and more preferably in the range from 0.4 to 1.0. Particularly preferable electron-pulling groups are a carbamoyl group, an alkoxycarbonyl group, an alkylsulfonyl group and an alkylphosphoryl group. The most preferable one is a carbamoyl group above all.

X is preferably an electron-pulling group, and more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group and a sulfamoyl group. In particular, a halogen atom is preferred. Among halogen atoms, a chlorine atom, a bromine atom and iodine atom are preferable, a chlorine atom and a bromine atom are more preferable and a bromine atom is particularly preferable.

For the heterocyclic group represented by Q in General Formula (III), it is preferable that the heterocyclic group is a saturated or unsaturated single ring of 5 to 7 members or its condensed ring which include one or more hetero atoms selected from the group comprising a nitrogen atom, an oxygen atom and a sulfur atom. Examples of the heyerocyclic ring preferably include pyridine, quinoline, isoquinoline, pyrimidine, pyrazine, pyridazine, phthalazine, triazine, furan, thiophene, pyrrol, oxazole, benzoxazole, thiazole, benzothiazole, imidazole, benzoimidazole, thiadiazole, and triazole. More preferably, pyridine, quinoline, pyrimidine, thiadiazole, and benzothiazole are mentioned. Particularly preferable ones are pyridine, quinoline and pyrimidine.

The heterocyclic group represented by Q may have a substituent. For example, the same substituents as the substituents of the alkyl group represented by Q can be mentioned.

A particularly preferable group for Q is a phenyl group substituted by an electron-pulling group in which the Hammet's σp has a positive value.

As the substituent for Q, Q may have a ballast group to be used in a photographic material for lowering diffusibility, a group capable of adsorbing on a silver salt, or a group contributing for being water-soluble. Q may polymerize one another to form a polymer. The substituents may bond one another to form a bis type, a tris type or a tetrakis type.

In General Formula (III), Y represents a divalent bonding group. Preferable ones are —$SO_2$—, —SO— and —CO—, and particularly preferable one is —$SO_2$—.

In General Formula (III), n represents 0 or 1. Preferably n is 1.

Each of $Z^1$ and $Z^2$ independently represents a halogen atom (e.g., a fluorine atom, a chlorine atom, a bromine atom and an iodine atom). The most preferable case is that both of $Z^1$ and $Z^2$ are bromine atoms.

X represents a hydrogen atom or an electron-pulling group. The electron-pulling group represented by X is a substituent in which the Hammet's substitution constant σp can take a positive value. Specifically, a cyano group, an alkoxycarbonyl group, an aryloxycarbonyl group, a carbamoyl group, a sulfamoyl group, an alkylsulfonyl group, an arylsulfonyl group, a halogen atom, an acyl group, and a heterocyclic group are mentioned. The most preferable one is a bromine atom.

Examples of the polyhalogen compound in General Formula (III) include compounds described in U.S. Pat. Nos. 3,874,946, 4,756,999, 5,340,712, 5,369,000, 5,464,737, Japanese Patent Laid-Open No. 137126/1975, Japanese Patent Laid-Open No. 89020/1975, Japanese Patent Laid-Open No. 119624/1975, Japanese Patent Laid-Open No. 57234/1984, Japanese Patent Laid-Open No. 2781/1995, Japanese Patent Laid-Open No. 5621/1995, Japanese Patent Laid-Open No. 160164/1997, Japanese Patent Laid-Open No. 197988/1998, Japanese Patent Laid-Open No. 244177/1997, Japanese Patent Laid-Open No. 244178/1997, Japanese Patent Laid-Open No. 160167/1997, Japanese Patent Laid-Open No. 319022/1997, Japanese Patent Laid-Open No. 258367/1997, Japanese Patent Laid-Open No. 265150/1997, Japanese Patent Laid-Open No. 319022/1997, Japanese Patent Laid-Open No. 197989/1998, Japanese Patent Laid-Open No. 242304/1999, Japanese Patent Application No. 181459/1998, Japanese Patent Application No. 292864/1998, Japanese Patent Application No. 90095/1999, Japanese Patent Application No, 89773/1999, and Japanese Patent Application No. 205330/1999.

Specific examples of the polyhalogen compound represented by General Formula (III) are shown in the following. Compounds employable in the invention are, however, not construed as being limited by the examples.

(III-1)

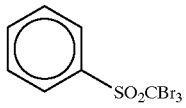

(III-2)

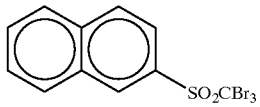

(III-3)

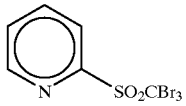

(III-4)

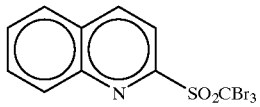

(III-5)

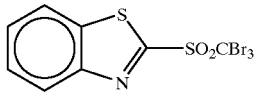

(III-6)

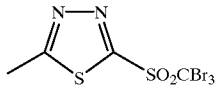

(III-7)

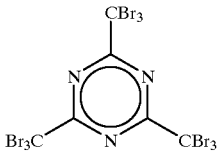

(III-8)

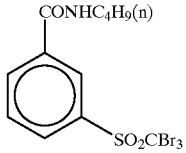

(III-9)

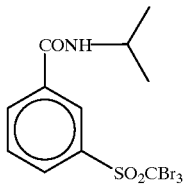

-continued (III-10)

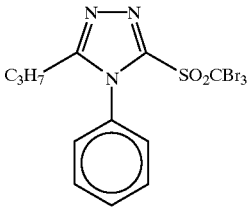

(III-11)

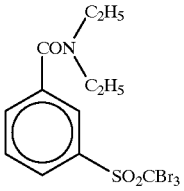

(III-12)

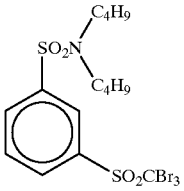

(III-13)

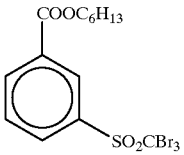

(III-14)

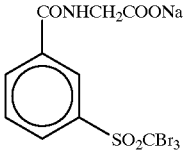

(III-15)

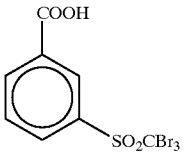

(III-16)

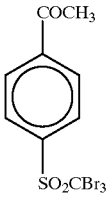

(III-17)

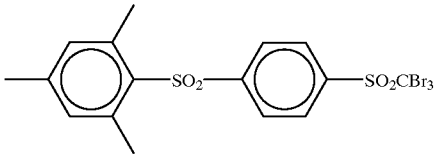

-continued (III-18)

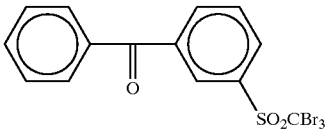

(III-19)

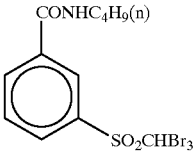

(III-20)

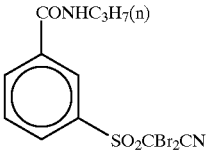

(III-21)

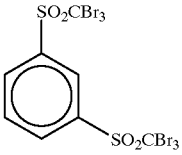

(III-22)

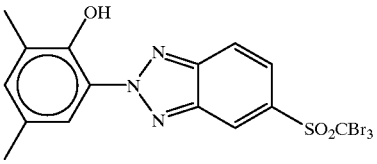

(III-23)

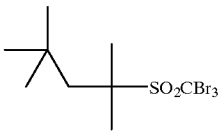

The polyhalogen compound represented by General Formula (III) can be used as one kind solely or two or more kinds in combination.

The compound represented by General Formula (III) is preferably used in the range from $10^{-4}$ mol to 1 mol per 1 mol of the photo-insensitive silver salt in the image-forming layer, more preferably from $10^{-3}$mol to 0.8 mol, and furthermore preferably from $5\times10^{-3}$ mol to 0.5 mol.

In the invention, for the method of incorporating the antifoggant into the heat-developable photosensitive material, methods described in the method of incorporating the reducing agent can be referred. The organic polyhalogen compound is also preferably added as a solid fine particle dispersion.

As other antifoggants, mercury (II) salts described in Japanese Patent Laid-Open No. 65021/1999, paragraph [0113]; benzoic acids described in Japanese Patent Laid-Open No. 65021/1999, paragraph [0114]; salicylic acid derivatives represented by Formula (Z) in Japanese Patent Application No. 87297/1999; formalin scavenger compounds represented by Formula (S) in Japanese Patent Application No. 23995/1999; triazine compounds related to CLAIM 9 in Japanese Patent Laid-Open No. 352624/1999; compounds representd by General Formula (III) in Japanese Patent Laid-Open No. 11791/1994; and 4-hydoxy-6-methyl-1,3,3a,7-tetrazaindene are mentioned.

The heat-developable photosensitive material in the invention may contain an azolium salt for the purpose of inhibiting fog. For the azolium salt, compounds represented by General Formula (XI) in Japanese Patent Laid-Open No. 193447/1984, compounds described in Japanese Patent Publication No. 12581/1980, and compounds represented by General Formula (II) in Japanese Patent Laid-Open No. 153039/1985 are cited. The azolium salt may be added in any part of the heat-developable photosensitive material. However, as a layer to be added with the azolium salt, the layer on the surface (which may be called as the image-forming surface, hereinafter) having the image-forming layer (a photosensitive layer) is preferable, and the layer containing the organic silver salt is more preferable. The time to add the azolium salt may be in any process for preparing a coating solution. In case of adding the azolium salt to the layer containing the organic silver salt, the azolium salt may be added in any process from preparation of the organic silver salt to preparation of a coating solution. The azolium salt is preferably added at a time after preparation of the organic silver salt and immediately before coating. For the addition methods of the azolium salt, any method of using powder, a solution or a fine particle dispersion may be adopted. The azolium salt may also be added as a solution mixed with other additives such as a sensitizing dye, a reducing agent and a toner. In the invention, the addition amount of the azolium salt may be optional, preferably in the range from $1\times10^{-6}$ mol to 2 mol per 1 mol of silver, and more preferably in the range from 1×10mol to 0.5 mol.

In the invention, for the purposes of controlling development by inhibiting or accelerating development, of improving spectral sensitization efficiency and of improving preservation after and before development, a mercapto compound, a disulfide compound and a thione compound can be incorporated. Compounds described in Japanese Patent Laid-Open No. 62899/1998, paragraphs [0067] to [0069], compounds represented by General Formula (I) and their specific examples in paragraphs [0033] to [0052] in Japanese Patent Laid-Open No. 186572/1998, compounds described in European Patent Laid-Open No. 0803764A1, pp. 20 line 35 to 56, and compounds described in Japanese Patent Laid-Open No, 273670/1999 are cited. Among them, mrecapto-substituted heteroaromatic compounds are preferable.

In the heat-developable photosensitive material of the invention, a toner is preferably added. Toners are described in Japanese Patent Laid-Open No. 62899/1998, paragraphs [0054] to [0055], European Patent Laid-Open No. 0803764A1, pp. 21 line 23 to 48, Japanese Patent Laid-Open No. 356317/2000 and Japanese Patent Application No. 187298/2000. In particular, phthalazinones [phthalazinone, phthalazinone derivatives or their metal salts, e.g., 4-(1-naphthyl) phthalazinone, 6-chlorophthalazinone, 5,7-dimethoxy phthalazinone and 2,3-dihydro-1,4-phthalazinedione]; combinations between phthalazinones and phthalic acids (e.g., phthalic acid, 4-methylphthalic acid, 4-nitrophthalic acid, diammonium phthalate, sodium phthalate, potassium phthalate and tetrachlorophthalic anhydride); phthalazines [phthalazine, phthalazine derivatives or their metal salts, e.g., 4-(1-naphthyl) phthalazine, 6-isopropylphthalazine, 6-tert-butylphthalazine, 6-chlorophthalazine, 5,7-dimethoxyphthalazine and 2,3-dihydrophthalazine]; and combinations between phthalazines and phthalic acids are preferable. The combinations between phthalazines and phthalic acids are particularly preferred.

Plasticizers and lubricants employable in the photosensitive layer of the heat-developable photosensitive material of the invention are described in Japanese Patent Laid-Open No. 65021/1999, paragraph [0117]. Regarding super-high gradation agents, their addition methods and their addition amounts to form an image of super-high gradation, the followings can be cited: descriptions in Japanese Patent Laid-Open No. 65021/1999, paragraph [0118] and Japanese Patent Laid-Open No. 223898/1999, paragraphs [0136] to [0193], compounds represented by Formula (H), Formula (1) to (3) and Formula (A) and (B) in Japanese Patent Application No. 87297/1999, and compounds represented by General Formula (III) to (V) in Japanese Patent Application No. 91652/1999. High gradation accelerators are described in Japanese Patent Laid-Open No. 65021/1999, paragraph [0102] and Japanese Patent Laid-Open No. 223898/1999, paragraph [0194] to [0195].

When formic acid or its salt is used as a strong fogging substance, the fogging substance is preferably contained on the surface side having the image-forming layer in an amount of 5 milimol or less per 1 mol of silver, and more preferably in an amount of 1 milimol or less.

When the super-high gradation agent is used in the heat-developable photosensitive material of the invention, it is preferable to use an acid formed by hydration of phosphorus pentoxide or its salt in combination. As the acids formed by hydration of phosphorus pentoxide or their salts, meta-phosphoric acid (salt), pyro-phosphoric acid (salt), ortho-phosphoric acid (salt), triphosphoric acid (salt), tetra-phosphoric acid (salt), and hexameta-phosphoric acid (salt) can be mentioned. Particularly preferable acids formed by hydration of phosphorus pentoxide or their salts are ortho-phosphoric acid (salt) and hexameta-phosphoric acid (salt). Specific examples of the salt include sodium ortho-phosphate, sodium dihydrogen ortho-phosphate, sodium hexameta-phosphate and ammonium hexameta-phosphate.

A use amount of the acid formed by hydration of phosphorus pentoxide or its salt (a coated amount per 1 $m^2$ of the photosensitive material) may be a desired amount according to the properties such as photosenstivity and fog, preferably in the range from 0.1 $mg/m^2$ to 500 $mg/m^2$, and more preferably from 0.5 $mg/m^2$ to 100 $mg/m^2$.

The heat-developable photosensitive material in the invention may have a surface protective layer for the purpose of preventing adhesion of the image-forming layer. The surface protective layer may be a single layer or a plurality of layers. Surface protective layers are described in Japanese Patent Laid-Open No. 65021/1999, paragraphs [0119] to [0120] and Japanese Patent Application No. 171936/2000.

For the binder in the surface protective layer constituting the heat-developable photosensitive material in the invention, gelatin is preferably used, and polyvinyl alcohol (PVA) is also preferably used solely or in combination with gelatin. For gelatin, inert gelatin (e.g., Nitta Gelatin 750) and phthalated gelatin (e.g., Nitta Gelatin 801) can be used. For PVA, those described in Japanese Patent Application No. 171936/2000, paragraphs [0009] to [0020] can be cited. PVA-105 as a completely saponified substance, PVA-205 as a partly saponified substance, PVA-335, and MP-203 as a modified polyvinyl alcohol (these are manufactured by Kuraray Co., Ltd.) are preferably mentioned. A coated amount (per 1 $m^2$ of the support) of polyvinyl alcohol for the protective layer (per one layer) is preferably in the range from 0.3 $g/m^2$ to 4.0 $g/m^2$, and more preferably from 0.3 $g/m^2$ to 2.0 $g/m^2$.

When the heat-developable photosensitive material of the invention is applied for the printing use where a dimensional change becomes a significant problem, it is preferable to use the polymer latex in the surface protective layer and the back layer. Reqarding such polymer latexes, descriptions are found in *Synthetic Resin Emulsion,* compiled by Taira Okuda and Hiroshi Inagaki, Kobunshi Kankokai (Polymer Publishing), 1978, *Application of Synthesized Latex,* compiled by Takaaki Sugimura, Yasuo Kataoka, Soichi Suzuki and Keiji Kasahara, Kobunshi Kankokai (Polymer Publishing), 1993, and Soichi Muroi, *Chemistry of Synthesized Latex,* Kobunshi Kankokai (Polymer Publishing), 1970. Specific examples of the polymer latex include a latex of a methyl methacrylate (33.5 wt %)/ethyl acrylate (50 wt %)/methacrylic acid (16.5 wt %) copolymer, a latex of a methyl methacrylate (47.5 wt %)/butadiene (47.5 wt %)/itaconic acid (5 wt %) copolymer, a latex of an ethyl acrylate/methacrylic acid copolymer, a latex of a methyl methacrylate (58.9 wt %)/2-ethylhexyl acrylate (25.4 wt %)/styrene (8.6 wt %)/2-hydroxyethyl metacrylate (5.1 wt %)/acrylic acid (2.0 wt %) copolymer, and a latex ofa methyl methacrylate (64.0wt %)/styrene (9.0wt%)/butylacrylate (20.0 wt %)/2-hydroxyethyl metacrylate (5.0 wt %)/acrylic acid (2.0 wt %) copolymer. Further, to the binder for the surface protective layer, combinations of polymer latexes described in Japanese Patent Application No. 6872/1999, techniques described in Japanese Patent Application No. 143058/1999, paragraphs [0021] to [0025], techniques described in Japanese Patent Application No. 6872/1999, paragraphs [0027] to [0028], and techniques described in Japanese Patent Application No. 19678/2000, paragraphs [0023] to [0041] maybe applied. A ratio of the polymer latex in the surface protective layer is preferably in the range from 10 wt % to 90 wt % of the entire binders, and preferably in particular in the range from 20 wt % to 80 wt %.

A coated amount (per 1 $m^2$ of the support) of the entire binder (including water-soluble polymers and latex polymers) is preferably in the range from 0.3 $g/m^2$to 5.0 $g/m^2$, and preferably in particular from 0.3 $g/m^2$ to 2.0 $g/m^2$.

A preparation temperature of the image-forming layer coating solution to be used in the invention is preferably in the range from 30° C. to 65° C., more preferably from 35° C. to a temperature lower than 60° C., and furthermore preferably from 35° C. to 55° C. It is preferred that the temperature of the image-forming layer coating solution immediately after addition of the polymer latex is maintained in the range from 30° C. to 65° C.

In the invention, the image-forming layer is formed with one or more layers on the support. In case of being formed with one layer, the layer comprises the organic silver salt, the photosensitive silver salt, the reducing agent and the binder, and includes additional materials desired like a toner, a covering aid and other auxiliary agents according to necessity. In case of being formed with two or more layers, the first image-forming layer (normally a layer adjacent to the support) includes the organic silver salt and the photosensitive silver salt, and the second image-forming layer or both layers must include some of other components. Constitution of a multi-color photosensitive heat-developable photographic material may include a combination of these two layers for each color. Further, all the components may be included in one layer as described in U.S. Pat. No. 4,708,928. In case of a multi-dye & multi-color photosensitive heat-developable photographic material, each emulsion layer is generally maintained as being separated one another by using a functional or non-functional barrier layer between one photosensitive layer and another as described in U.S. Pat. No. 4,460,681.

In the invention, from the viewpoint of improvement of color tone, prevention of interference fringe pattern caused by an exposure with laser light and prevention of irradiation, various kinds of dyes and pigments (e.g., C. I. Pigment Blue 60, C. I. Pigment Blue 64, and C. I. Pigment Blue 15:6) can be used in the photosensitive layer. Concerning these matters, detailed descriptions are found in International Patent Laid-Open No. 36322/1998, Japanese Patent Laid-Open No. 268465/1998, and Japanese Patent Laid-Open No. 338098/1999.

In the heat-developable photosensitive material of the invention, an anti-halation layer can be formed at the farther side from a light source in relation to the photosensitive layer.

The heat-developable photosensitive material generally has a photo-insensitive layer in addition to the photosensitive layer. The photo-insensitive layer can be classified according to its position as follows; (1) a protective layer formed on the photosensitive layer (on the farther side from the support), (2) an intermediate layer formed between plural photosensitive layers or between the photosensitive layer and the protective layer, (3) an undercoat layer formed between the photosensitive layer and the support, and (4) a back layer formed on the opposite side of the photosensitive layer. A filter layer is formed in the photosensitive material as a layer classified in (1) or (2). The anti-halation layer is formed in the photosensitive material as a layer classified in (3) or (4).

Regarding the anti-halation layer, descriptions are found in Japanese Patent Laid-Open No. 65021/1999, paragraphs [0123] to [0124], Japanese Patent Laid-Open No. 223898/1999, Japanese Patent Laid-Open No. 230531/1997, Japanese Patent Laid-Open No. 36695/1998, Japanese Patent Laid-Open No. 104779/1998, Japanese Patent Laid-Open No. 231457/1999, Japanese Patent Laid-Open No. 352625/1999, and Japanese Patent Laid-Open No. 352626/1999.

The anti-halation layer contains an anti-halation dye having photo-absorption in the wavelength region of exposure light. In case that the exposure wavelength is in an infrared region, a dye absorbing infrared light is suitably used, wherein the dye having no absorption in the visible wavelength region is preferred.

When anti-halation is performed by using a dye having absorption in the visible wavelength region, it is preferred that color of the dye does not remain substantially after image-formation. Any methods for dye to be decolorized by heat in heat development is preferably used. It is particularly preferable that a heat-decolorizable dye and a base precursor are added in the photo-insensitive layer to be functional as an anti-halation layer. These techniques are described in Japanese Patent Laid-Open No. 231457/1999.

An addition amount of the decolorizable dye is determined according to the way of using the dye. Generally, the decolorizable dye is used in such an amount that an optical density (absorbance) measured at the objective wavelength exceeds 0.1. The optical density is preferably in the range from 0.2 to 2. A use amount of the decolorizable dye for obtaining such a level of the optical density is generally in the range approximately from 0.001 $g/m^2$ to 1 $g/m^2$.

When the dye is decolorized in such a way, the optical density after heat development can be lowered to 0.1 or less. Two or more kinds of decolorizable dyes may be used in combination in a heat-decolorizable type recording material or in the heat-developable photosensitive material. In the similar way, two or more kinds of base precursors maybe used in combination.

In heat declorization using such a decolorizable dye and the base precursor, from the viewpoint of the heat declorization property, it is preferable simultaneously to use a substance [e.g., diphenylsulfone, or 4-chlorophenyl (phenyl) sulfone] which decreases a melting point by 3° C. or more when mixed with the base precursor as described in Japanese Patent Laid-Open No. 35226/1999.

In the invention, a coloring agent having the absorption maximum in the wavelength region from 300 nm to 450 nm can be added for the purposes of improving silver color tone and improving image preservation. These coloring agents are described in Japanese Patent Laid-Open No. 210458/1987, Japanese Patent Laid-Open No. 104046/1988, Japanese Patent Laid-Open No. 103235/1988, Japanese Patent Laid-Open No. 208846/1988, Japanese Patent Laid-Open No. 306436/1988, Japanese Patent Laid-Open No. 314535/1988, Japanese Patent Laid-Open No. 61745/1989, and Japanese Patent Application No. 276751/1999.

Such a coloring agent is usually added in an amount in the range from 0.1 $mg/m^2$ to 1 $g/m^2$. As a layer to be added, the back layer provided on the opposite side of the photosensitive layer is preferred.

The heat-developable photosensitive material in the invention is preferably the so called one-sided photosensitive material having on one surface side of the support at least one layer of the photosensitive layer containing a silver halide emulsion and having the back layer on the opposite surface side.

In the invention, it is preferred to add a matting agent for improving transportability. Matting agents are described in Japanese Patent Laid-Open No. 65021, paragraphs [0126] to [0127]. A coated amount of the matting agent per 1 $m^2$ of the photosensitive material is preferably in the range from 1 $mg/m^2$ to 400 $mg/m^2$, and more preferably from 5 to 300 $mg/m^2$.

A matting degree of the image-forming surface may be any degree so far as no star dust-like defect occurs. However, a Beck's degree of smoothness is preferably in the range from 30 seconds to 2000 seconds, and particularly preferably in the range from 40 seconds to 1500 seconds. The Beck's degree of smoothness can easily be obtained according to *Testing Method for Smoothness of Paper and Paperboard with Beck's Tester,* the Japanese Industrial Standards (JIS) P8119 and the TAPPI Standard Method T479.

In the invention, the Beck's degree of smoothness as a matting degree for the back layer is preferably in the range from 10 seconds to 1200 seconds, more preferably from 20 seconds to 800 seconds, and furthermore preferably from 40 seconds to 500 seconds.

In the invention, the matting agent is preferably contained in the outermost surface layer or in a layer being functional as the outermost surface layer, or also preferably contained in a layer being functional as the so called protective layer.

Back layers applicable to the invention are described in Japanese Patent Laid-Open No. 65021/1999, paragraphs [0128] to [0130].

In the heat-developable photosensitive material of the invention, a film surface pH before heat development is preferably 7.0 or less, and more preferably 6.6 or less. The lower limit is not particularly restricted but approximately 3. Themost preferable range of pH is from 4 to 6.2. For adjusting the film surface pH, it is preferred, from the viewpoint of lowering the film surface pH, to use an organic acid such as a phthalic acid derivative, a non-volatile acid such as sulfuric acid or a volatile base such as ammonia. Particularly, ammonia is preferable for achieving a low film surface pH, because ammonia is particularly apt to be vaporized and can be removed during the coating process or before being heat-developed.

Further, it is also preferred that a non-volatile base such as sodium hydroxide, potassium hydroxide or lithium hydroxide is used with ammonia in combination. Besides, measurement methods of the film surface pH are described in Japanese Patent Application No. 87297/1999, paragraph [0123].

A hardening agent may be used in each layer (e.g., the image-forming layer, the protective layer and the back layer) constituting the heat-developable photosensitive material of the invention. Examples of the hardening agent are found in various methods described in T. H. James, *The Theory of the Photographic Process,* $4^{th}$ edition, Macmillan Publishing Co., Inc., 1977, pp. 77 to 87. In addition to compounds such as chrome alum, sodium salt of 2,4-dichloro-6-hydroxy-s-triazine, N,N-ethylene bis(vinylsulfonacetamide) and N,N-propylene bis(vinylsulfonacetamide), multi-valent metal ions described in the above-cited reference, pp, 78, polyisocyanates described in U.S. Pat. No. 4,281,060 and Japanese Patent Laid-Open No. 208193/1994, epoxy compounds described in U.S. Pat. No. 4,791,042, and vinyl sulfone type compounds described in Japanese Patent Laid-Open No. 89048/1987 are preferably used.

The hardening agent is added as a solution. The time to add a hardening agent solution into the protective layer coating solution is from 180 minutes before coating to immediately before coating, and preferably from 60 minutes before coating to 10 seconds before coating. However, mixing methods and mixing conditions for the hardening agent solution are not particularly restricted so far as the effects of the invention are sufficiently revealed. Specific examples of the mixing method include a mixing method using a tank in which an average staying time calculated from an addition flow rate and a feeding flow rate to a coater is adjusted to be a desired time, and a mixing method using a static mixer described in N. Harnby, M. F. Edwards and A. W. Nienow, *Techniques of Mixing Liquids,* translated by Koji Takahashi, Nikkan Kogyo Newspaper, 1989, Chapter 8.

Surfactants to be applicable to the invention are described in Japanese Patent Laid-Open No. 65021/1999, paragraph [0132], solvents are described in ibid., paragraph [0133], static electrification-preventive or conductive layers are described in ibid., paragraph [0135], methods for obtaining an color image are described in ibid., paragraph [0136], and lubricants are described in Japanese Patent Laid-Open No. 84573/1999, paragraphs [0061] to [0064] and Japanese Patent Application No. 106881/1999, paragraphs [0049] to [0062].

It is preferable that the heat-developable photosensitive material is a mono-sheet type (a type capable of forming an image on the heat-developable photosensitive material without using a separate sheet such as an image-receiving material).

To the heat-developable photosensitive material, an antioxidant, a stabilizing agent, a plasticizer, an ultra-violet light-absorbing agent or a covering aid may further be added. These various additives are added to either of the photosensitive layer or the photo-insensitive layer. Concerning those matters, International Patent Laid-Open No. 36322/1998, European Patent Laid-Open No. 803764A1, Japanese Patent Laid-Open No. 186567/1998 and Japanese Patent Laid-Open No. 18568/1998 can be referred.

An emulsion layer (the photosensitive layer or the image-forming layer) coating solution for the heat-developable photosensitive material of the invention may be coated by any method. Specifically, various coating operations including extrusion coating, slide coating, curtain coating, dip coating, knife coating, flow coating, and extrusion coating using a kind of hopper described in U.S. Pat. No. 2,681,294 are used. Extrusion coating or slide coating described in Stephen F. Kistler and Peter M. Schweizer, *Liquid Film Coating,* Chapman & Hall, 1997, pp. 399 to 536 is preferably used. In particular, slide coating is preferably used. Examples of the shape of a slide coater used for slide coating are described in the above-cited book, pp. 427, FIG. 11*b*-1. In compliance with the request, two or more layers can simultaneously be coated by methods described in the above-cited book, pp. 399 to 536, U.S. Pat. No. 2,761,791 and British Patent 837,095.

It is preferable that the organic silver salt-containing layer coating solution in the invention is the so-called thixotropic fluid. Regarding this technique, Japanese Patent Laid Open No. 52509/1999 can be referred. For the organic silver salt-containing layer coating solution in the invention, a viscosity at the shearing velocity of 0.1 $s^{-1}$ is preferably in the range from 400 mPa·s to 100,000 ma·s, and more preferably from 500 mPa·s to 20,000 mPa·s. Besides, a viscosity at the shearing velocity of $1000S^{-1}$ is preferably in the range from 1 mPa·s to 200 mPa·s, and more preferably from 5 mPa·s to 80 mPa·s.

For techniques employable in the heat-developable photosensitive material of the invention, techniques described in the following references are further cited: European Patent Laid-Open No. 803764A1, European Patent Laid-Open No. 883022A1, International Patent Laid-Open No. 36322/1998, Japanese Patent Laid-Open No. 62648/1981, Japanese Patent Laid-Open No. 62644/1983, Japanese Patent Laid-Open No. 43766/1997, Japanese Patent Laid-Open No. 281637/1997, Japanese Patent Laid-open No. 297367/1997, Japanese Patent Laid-open No. 304869/1997, Japanese Patent Laid-Open No. 311405/1997, Japanese Patent Laid-Open No. 329865/1997, Japanese Patent Laid-Open No. 10669/1998, Japanese Patent Laid-Open No. 62899/1998, Japanese Patent Laid-Open No. 69023/1998, Japanese Patent Laid-open No. 186568/1998, Japanese Patent Laid-Open No. 90823/1998, Japanese Patent Laid-open No. 171063/1998, Japanese Patent Laid-Open No. 186565/1998, Japanese Patent Laid-Open No. 186567/1998, from Japanese Patent Laid-Open No. 186569/1998 to Japanese Patent Laid-Open No. 186572/1998, Japanese Patent Laid-Open No. 197974/1998, Japanese Patent Laid-Open No. 197982/1998, Japanese Patent Laid-Open No. 197983/1998, from Japanese Patent Laid-Open No. 197985/1998 to Japanese Patent Laid-Open No. 197987/1998, Japanese Patent Laid-Open No. 207001/1998, Japanese Patent Laid-Open No. 207004/1998, Japanese Patent Laid-Open No. 221807/1998, Japanese Patent Laid-Open No. 282601/1998, Japanese Patent Laid-Open No. 288823/1998, Japanese Patent Laid-Open No. 288824/1998, Japanese Patent Laid-Open No. 307365/1998, Japanese Patent Laid-Open No. 312038/1998, Japanese Patent Laid-Open No. 339934/1998, Japanese Patent Laid-Open No. 7100/1999, Japanese Patent Laid-Open No. 15105/1999, Japanese Patent Laid-Open No. 24200/1999, Japanese Patent Laid-Open No. 24201/1999, Japanese Patent Laid-Open No. 30832/1999, Japanese Patent Laid-Open No. 84574/1999, Japanese Patent Laid-Open No. 65021/1999, Japanese Patent Laid-Open No. 109547/1999, Japanese Patent Laid-Open No. 125880/1999, Japanese Patent Laid-Open No. 129629/1999, Japanese Patent Laid-Open No. 7100/1999, from Japanese Patent Laid-Open No. 133536/1999 to Japanese Patent Laid-Open No. 133539/1999, Japanese Patent Laid-Open No. 133542/1999, Japanese Patent Laid-Open No. 133543/1999, Japanese Patent Laid-Open No. 223898/1999, Japanese Patent Laid-Open No. 352627/1999, Japanese Patent Laid-Open No. 305377/1999, Japanese Patent Laid-Open No. 305378/1999, Japanese Patent Laid-Open No. 305384/1999, Japanese Patent Laid-Open No. 305380/1999, Japanese Patent Laid-Open No. 316435/1999, Japanese Patent Laid-Open No. 327076/1999, Japanese Patent Laid-Open No. 338096/1999, Japanese Patent Laid-Open No. 338098/1999, Japanese Patent Laid-Open No. 338099/1999, Japanese Patent Laid-Open No. 343420/1999, Japanese Patent Application No. 187298/2000, Japanese Patent Application No. 10229/2000, Japanese Patent Application No. 47345/2000, Japanese Patent Application No. 206642/2000, Japanese Patent Application No. 98530/2000, Japanese Patent Application No. 98531/2000, Japanese Patent Application No. 112059/2000, Japanese Patent Application No. 112060/2000, Japanese Patent Application No. 112104/2000, Japanese Patent Application No. 112064/2000, Japanese Patent Application No. 171936/2000 and Japanese Patent Application No. 282190/1999.

The heat-developable photosensitive material of the invention may be developed by any process. Usually, the heat-developable photosensitive material exposed image-wise is temperature-elevated, and developed. A preferable development temperature is in the range from 80° C. to 250° C., and the more preferable development temperature is in the range from 100° C. to 140° C. The development time is preferably from 1 second to 60 seconds, more preferably from 5 seconds to 30 seconds, and in particular, preferably from 10 seconds to 20 seconds.

A plate heater system is preferably used as a heat development process. For the heat development process utilizing a plate heater system, processes described in Japanese Patent Laid-Open No. 133572/1999 are preferable. These processes include a heat development apparatus for obtaining a visible image by making a heat-developable photosensitive material, in which a latent image has been formed, contact with a heating unit in a heat development part. The heating unit comprises plate heaters and a plurality of pressing rollers arranged along one surface side of the plate heaters and in the position of facing to the surface. The heat-developable photosensitive material is carried between the pressing rollers and the plate heaters to be heat-developed. It is preferable that the plate heaters are divided into 2 to 6 steps, and that the top step has a temperature lowered by approximately 1° C. to 10° C. Such methods are also described in Japanese Patent Laid-Open No. 30032/1979. According to these methods, moisture and organic solvents contained in the heat-developable photosensitive material can be removed out of the material, and deformation of the support of the heat-developable photosensitive material caused by rapid heating can also be suppressed.

The heat-developable photosensitive material of the invention may be exposed to light by any method. Laser beams are preferably used as a light source for exposure. For the laser light according to the invention, a gas laser ($Ar^+$, or He—Ne), a YAG laser, a dye laser, and a semiconductor laser are preferable. Further, a semiconductor laser with an element generating the second harmonic waves can also be used. A gas laser or a semiconductor laser radiating red to infra red light is preferred.

As a laser imager having an exposure part and a heat development part for the medical use, Fuji Medical Dry Laser Imager FM-DP L (manufactured by Fuji Photo Film Co., Ltd.) can be mentioned. Descriptions regarding FM-DP L are found in *Fuji Medical Review* No. 8, pp. 39 to 55. It goes without saying that these techniques are applicable to the laser imager for the heat-developable photosensitive material of the invention. The heat-developable photosensitive material can also be applied for the laser imager in "AD network" proposed by Fuji Medical System as a network system adapted to the DICOM Standards.

The heat-developable photosensitive material of the invention forms a black and white image based on a silver image. Therefore, it is preferred that the heat-developable photosensitive material is used as a heat-developable photosensitive material for the medical diagnosis, as a heat-developable photosensitive material for the industrial photography, as a heat-developable photosensitive material for the printing use, and as a heat-developable photosensitive material for the COM use.

EXAMPLE

The features of the present invention are further specifically explained in the following examples and comparative examples. The materials, the amount of use, the ratio, the content of treatment, and the steps of procedure may properly be changed as far as they do not deviate from the effect of the invention. Therefore, the domain of the invention should not be construed as being limited by the specific examples described below.

Example 1

<<Preparation of PET Support>>

PET having an intrinsic viscosity IV=0.66 [measured at 25° C. in phenol/tetrachlorethane=6/4 (a ratio by weight)] was obtained according to an ordinary preparation method by using terephthalic acid and ethylene glycol. After the obtained PET is pelletized, the pellets were dried at 130° C. for 4 hours. After being melted at 300° C., PET was extruded from a T-type die, and rapidly quenched, thereby an unstretched film having a film thickness to become 175 μm in thickness after thermal fixation was prepared.

This film was stretched up to 3.3 times in the machine direction with rollers having different peripheral velocities, then up to 4.5 times in the transverse direction by means of a tenter. The temperatures at that time were 110° C. and 130° C. respectively. Subsequently, the film was subjected to thermal fixation at 240° C. for 20 seconds, then to relaxation by 4% in the transverse direction at the same temperature. The chucking parts of the tenter were then slit off, and the both edges of the film were subjected to knurl processing. The film was rolled at 4 kg/cm$^2$ to obtain a roll of film having a thickness of 175 μm.

<<Corona Discharge Surface Treatment>>

Both surfaces of the support were treated at a room temperature at the web handling velocity of 20 m/min with a corona discharge processor (a solid state corona discharge processor model 6KVA manufactured by Pillar Co.). From the values of electric current and voltage read at that time, it was found that a treatment of 0.375 kV·A·min/m$^2$ was applied to the support. A treatment frequency was 9.6 kHz and a gap clearance between an electrode and a dielectric roll was 1.6 mm.

<<Preparation of Undercoated Support>>

1. Preparation of Undercoat Layer Coating Solutions

Prescription-1 (For an Undercoat Layer on the Image-forming Layer Side)

- An aqueous dispersion of polyester (its kind is shown in TABLE 1). (An addition amount is corresponding to the film thickness described in TABLE 1)
- Fine particles of non-cross-linking polymethylmethacrylate (MP-1000, average particle diameter: 0.4 μm, manufactured by Soken Kagaku Co., Ltd.) 0.9 g
- Polyethylene glycol mononononylphenyl ether (average number of ethylene oxide=8.5, 10 wt % solution) 2 g
- Distilled water 1000 ml Prescription-2 (For the First Layer on the Back Surface Side)

- Styrene/butadiene copolymer latex 131 g (solid content: 40 wt %, weight ratio of styrene/butadiene=68/32)
- Sodium salt of 2,4-dichloro-6-hydroxy-s-triazine (8 wt % aqueous solution) 5 g
- Polystyrene particles (average particle diameter: 2 μm, 20 wt % aqueous dispersion) 0.5 g
- Distilled water 863.5 ml Prescription-3 (For the Second Layer on the Back Surface Side)

- $SnO_2$/SbO (9/1 weight ratio, average particle diameter; 0.04 μm, 17 wt % dispersion) 62 g
- Gelatin (10 wt % aqueous solution) 66 g
- Metolose TC-5 (manufactured by Shin-Etsu Chemical Co., Ltd. , 2 wt % aqueous solution) 6 g
- Proxel (manufactured by ICI Co., Ltd.) 0.5 ml
- Distilled water 865.5 ml (2) Preparation of Undercoated Support After giving the corona discharge treatment on each of both surfaces of the biaxially stretched polyethylene terephthalate support having a thickness of 175 μm, the undercoat layer coating solution of Prescription-1 was coated on the one surface (the image-forming surface) by means of a wire-bar in a wet coated amount of 6.6 ml/m$^2$ (per one surface) and dried at 180° C. for 5 minutes. Then, the undercoat layer coating solution of Prescription-2 was coated on the opposite surface (the back surface) by means of a wire-bar in a wet coated amount of 5.7 ml/m$^2$ and dried at 180° C. for 5 minutes. Further, the undercoat layer coating solution of Prescription-3 was coated on the surface (the back surface) by means of a wire-bar in a wet coated amount of 7.7 ml/m$^2$ and dried at 180° C. for 6 minutes. Thus, the undercoated support was prepared.

<<Preparation of Back Surface Coating Solutions>>

(1) Preparation of Solid Fine Particle Dispersion (a) of Base Precursor 64 g of Base Precursor Compound 11, 28 g of diphenylsulfone and 10 g of a surfactant (Demol N manufactured by Kao Corporation) were mixed with 220 ml of distilled water. The mixture was dispersed by using beads with a sand-mill (¼ Gallon Sand Grinder Mill manufactured by Imex Co., Ltd.). Solid Fine Particle Dispersion (a) of the base precursor compound having an average particle diameter of 0.2 μm was thus obtained. The structure of Base Precursor Compound 11 is shown below.

Base Precursor Compound 11

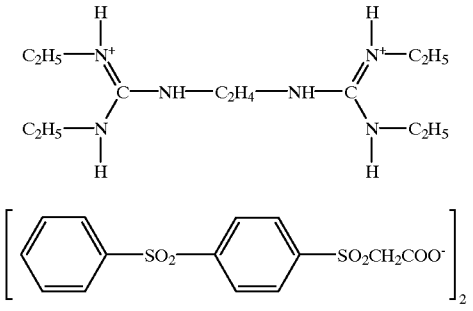

(2) Preparation of Solid Fine Particle Dispersion of Dye 9.6 g of Cyanine Dye Compound 12 and 5.8 g of sodium p-dodecylbenzene sulfonate were mixed with 305 ml of distilled water. The mixture was dispersed by using beads with a sand-mill (¼ Gallon Sand Grinder Mill manufactured by Imex Co., Ltd.), thereby the solid fine particle dispersion of the dye having an average particle diameter of 0.2 μm was obtained. The structure of Cyanine Dye Compound 12 is shown below.

Cyanine Dye Compound 12

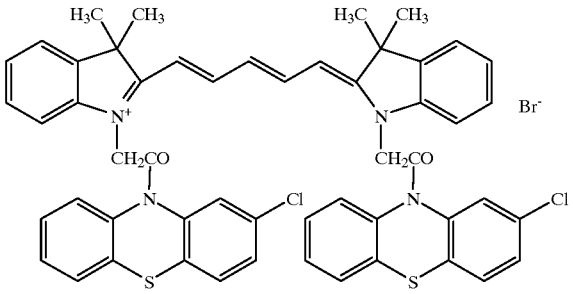

(3) Preparation of Anti-Halation Layer Coating Solution 17 g of gelatin, 9.6 g of polyacrylamide, 70 g of Solid Fine Particle Dispersion (a) of the base precursor, 56 g of the solid fine particle dispersion of the dye described in the above, 1.5 g of monodispersed fine particles of polymethyl methacrylate (average particle diameter: 8 μm, standard deviation: 0.4), 0.0 g of benzoisothiazolinone, 2.2 g of sodium polyethylene sulfonate, 0.2 g of Blue Dye Compound 13, 3.9 g of Yellow Dye Compound 14 and 844 ml of water were mixed. Thus, the anti-halation layer coating solution was prepared. Each structure of Blue Dye Compound 13 and Yellow Dye Compound 14 used in the preparation is shown below.

Blue Dye Compound 13

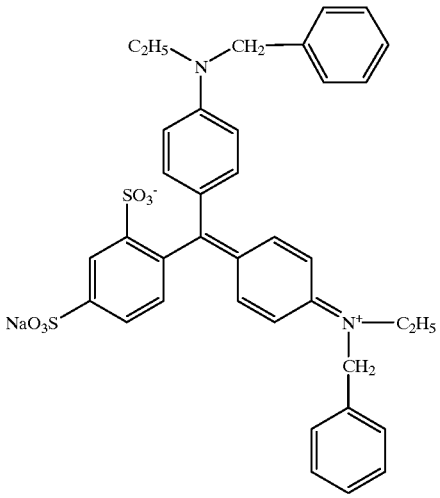

Yellow Dye Compound 14

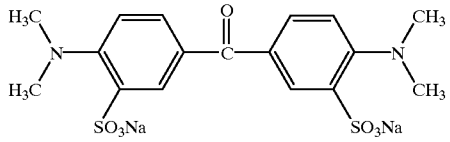

(4) Preparation of Back Surface Protective Layer Coating Solution

In a reaction vessel maintained at 40° C., a coating solution of the protective layer for the back surface was prepared by mixing 50 g of gelatin, 0.2 g of sodium polystyrene sulfonate, 2.4 g of N,N-ethylene bis(vinyl sulfone acetamide), 1 g of sodium tert-octylphenoxyethoxyethane sulfonate, 30 mg of benzoisothiazolinone, 37 mg of a fluorine type surfactant (F-1: potassium salt of N-perfluoroctylsulfonyl-N-propylglycine), 0.15 g of a fluorine type surfactant {F-2: polyethyleneglycol mono (N-perfluoroctylsulfonyl-N-propyl-2-aminoethyl) ether [average degree of polymerization of ethyleneoxide: 15]}, 64 mg of a fluorine type surfactant (F-3), 32 mg of a fluorine type surfactant (F-4), 8.8 g of an acrylic acid/ethylacrylate copolymer (weight ratio of copolymerization: 5/95), 0.6 g of Aerosol OT (manufactured by American Cyanamide Co.), 1.8 g of liquid paraffin in a liquid paraffin emulsion and 950 ml of water. Each structure of fluorine type surfactants, F-1, F-2, F-3 and F-4, used in the preparation is shown below.

(F-1)

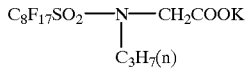

(F-2)

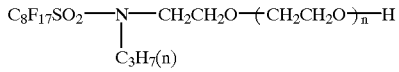

$n$ = 15 (average)

(F-3)

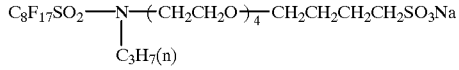

$C_8F_{17}SO_3K$ (F-4)

<<Preparation of silver Halide Emulsion>>

To 1,421 ml of distilled water, 3.1 ml of a 1 wt % potassium bromide solution was added, and further 3.5 ml of sulfuric acid in the concentration of 0.5 mol/L and 31.7 g of phthalated gelatin were added. The mixed solution was stirred and maintained at 30° C. in a reaction vessel made of stainless steel. Solution A containing 22.22 g of silver nitrate diluted with distilled water to 95.4 ml and Solution B containing 15.3 g of potassium bromide and 0.8 g of potassium iodide diluted with distilled water to 97.4 ml in volume were entirely added at a constant flow rate during 45 seconds to the foregoing solution. After that, 10 ml of a 3.5 wt % aqueous solution of hydrogen peroxide was added, and further 10.8 ml of a 10 wt % aqueous solution of benzimidazole was added. Furthermore, Solution C containing 51.86 g of silver nitrate diluted with distilled water to 317.5 ml and Solution D containing 44.2 g of potassium bromide and 2.2 g of potassium iodide diluted with distilled water to 400 ml in volume were prepared. Solution C was entirely added at a constant flow rate during 20 minutes. Solution D was added according to a controlled double jet method in keeping the pAg value at 8.1. After 10 minutes since the addition start of Solution C and Solution D, the total of potassium salt of iridium (III) hexachloric acid in an amount of $1\times10^{-4}$ mol per 1 mol of silver was added. Further, at five seconds after the addition completion of Solution C, the total of an aqueous solution of potassium hexacyanoferrate (II) in an amount of $3\times10^{-4}$ mol per 1 mol of silver was added. When the pH was adjusted to 3.8 with sulfuric acid in the concentration of 0.5 mol/L, stirring was stopped to perform precipitation/desalting/washing processes. With sodium hydroxide in the concentration of 1 mol/L, the pH was adjusted to 5.9, thereby a dispersion of silver halide having a pAg value of 8.0 was prepared.

To the silver halide dispersion while stirred and maintained at 38° C., 5 ml of a 0.34 wt % methanol solution of 1,2-benzoisothiazoline-3-one was added. After 40 minutes, a methanol solution of Spectral Sensitizing Dye A and Spectral Sensitizing Dye B in a molar ratio of 1:1 in an amount of $1.2\times10^{-3}$ mol (as the sum of Spectral Sensitizing Dye A and Spectral Sensitizing Dye B) per 1 mol of silver was added to the silver halide dispersion, the temperature of which was elevated up to 47° C. after a minute. After 20 minutes since the temperature elevation, a methanol solution of sodium benzene thiosulfonate in an amount of $7.6\times10^{-5}$ mol per 1 mol of silver was added. Further, after 5 minutes, a methanol solution of Tellurium Sensitizer C in an amount of $2.9\times10^{-4}$ mol per 1 mol of silver was added to the silver halide dispersion which was then subjected to ripening for 91 minutes. Then, 1.3 ml of a 0.8 wt % methanol solution of N,N'-dihydroxy-N"-diethylmelamine was added. Furthermore, after 4 minutes, a methanol solution of 5-methyl-2-mercaptobenzimidazol in an amount of $4.8\times10^{-3}$ mol per 1 mol of silver and a methanol solution of 1-phenyl-2-heptyl-5-mercapto-1,3,4-triazol in an amount of $5.4\times10^{-3}$ mol per 1 mol of silver were added. Thus, Silver Halide Emulsion 1 was prepared. Each structure of Spectral Sensitizing Dye A, Spectral Sensitizing Dye B and Tellurium Sensitizer C used in the preparation is shown below.

Spectral Sensitizing Dye A

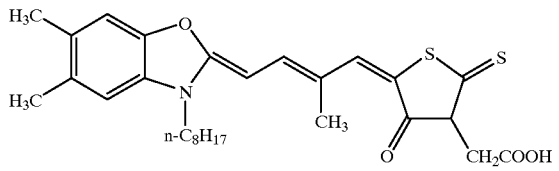

Spectral Sensitizing Dye B

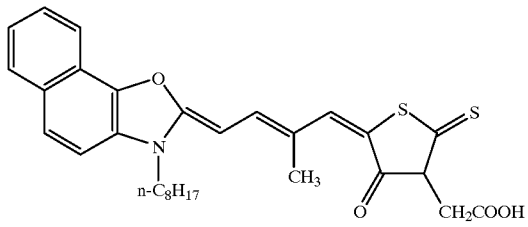

-continued

Tellurium Sensitizer C

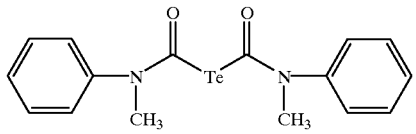

The grains in the prepared silver halide emulsion were silver iodobromide grains: having an average equivalent-sphere diameter of 0.042 μm; having an equivalent-sphere diameter variation coefficient of 20%; and containing evenly an iodium of 3.5 mol %. The grain size was brought from the average of 1,000 grains measured by means of an electron microscope. The {100} face ratio in these grains was obtained as 80% according to the Kubelka-Munk method.

<<Preparation of Silver Halide Emulsion 2>>

Silver Halide Emulsion 2 was prepared in the same manner as that in Silver Halide Emulsion 1 except that the temperature of solution in grain formation was changed from 30° C. to 47° C., Solution B was changed to a solution in which 15.9 g of potassium bromide had been diluted to 97.4 ml in volume, Solution D was changed to a solution in which 45.8 g of potassium bromide had been diluted to 400 ml in volume, the addition time of Solution C was changed to 30 minutes and potassium hexacyanoferrate (II) was eliminated. The precipitation/desalting/washing/dispersion processes were performed in the same manner as those for Silver Halide Emulsion 1. Furthermore, spectral sensitization, chemical sensitization, and addition of 5-methyl-2-mercaptobenzimidazol and 1-phenyl-2-heptyl-5-mercapto-1,3,4-triazol were conducted in the same manner as that of Silver Halide Emulsion 1 to obtain Silver Halide Emulsion 2, except that changes were done in an addition amount of the methanol solution of Spectral Sensitizing Dye A and Spectral Sensitizing Dye B in the molar ratio of 1:1 to $7.5\times10^{-4}$ mol (as the sum of Spectral Sensitizing Dye A and spectral Sensitizing Dye B) per 1 mol of silver, in an addition amount of Tellurium Sensitizer C to $1.1\times10^{-4}$ mol per 1 mol of silver and in an addition amount of 1-phenyl-2-heptyl-5-mercapto-1,3,4-triazol to $3.3\times10^{-3}$ mol per 1 mol of silver. The grains in Silver Halide Emulsion 2 were cubic grains of pure silver bromide having an average equivalent-sphere diameter of 0.080 μm and an equivalent-sphere diameter variation coefficient of 20%.

<<Preparation of Silver Halide Emulsion 3>>

Silver Halide Emulsion 3 was prepared in the same manner as that in Silver Halide Emulsion 1, except that the temperature of solution in grain formation was changed from 30° C. to 27° C. Also, the precipitation/desalting/washing/dispersion processes were performed in the same manner as that in Silver Halide Emulsion 1. Silver Halide Emulsion 3 was obtained in the same manner as that in Silver Halide Emulsion 1, except that the changes were done in an addition amount of Spectral Sensitizing Dye A and Spectral Sensitizing Dye B in the molar ratio of 1:1 as a solid dispersion (in a gelatin aqueous solution) to $6\times10^{-3}$ mol (as the sum of Spectral Sensitizing Dye A and Spectral Sensitizing Dye B) per 1 mol of silver, and in an addition amount of Tellurium Sensitizer C to $5.2\times10^{-4}$ mol per 1 mol of silver. The emulsion grains in Silver Halide Emulsion 3 were silver iodobromide grains containing 3.5 mol % of iodine uniformly and having an average equivalent-sphere diameter of 0.034 μm and an equivalent-sphere diameter variation coefficient of 20%.

<<Preparation of Silver Halide Mixed Emulsion A for Coating Solution>>

70 wt % of Silver Halide Emulsion 1, 15 wt % of Silver Halide Emulsion 2 and 15 wt % of Silver Halide Emulsion 3 were mixed and dissolved together to make a dispersion to which a 1 wt % aqueous solution of benzothiazolium iodide in amount of $7\times10^{-3}$ mol per 1 mol of silver was added. Further, water was added so as to obtain a silver halide content per 1 kg of a silver halide mixed emulsion for coating solution to be 38.2 g calculated in terms of silver, thereby Silver Halide Mixed Emulsion A for Coating Solution was prepared.

<<Preparation of Fatty Acid Silver Salt Dispersion>>

87.6 kg of behenic acid (Edenor C22-85R manufactured by Henkel Co.), 423 L of distilled water, 49.2 L of an aqueous solution of NaOH in the Concentration of 5 mol/L and 120 L of tert-butanol were mixed, and the mixture was allowed to react at 75° C. for 1 hour, thereby a sodium behenate solution was obtained. Apart from the sodium behenate solution, 206.2 L (pH 4.0) of an aqueous solution containing 40.4 kg of silver nitrate was prepared and maintained at 10° C. A reaction vessel charged with 635 L of distilled water and 30 L of tert-butanol was maintained at 30° C. The entire amount of the foregoing sodium behenate solution and the entire amount of the foregoing silver nitrate aqueous solution were added to the content in the reaction vessel at a constant flow rate during 93 minutes 15 seconds and during 90 minutes respectively with sufficient stirring. At that time, the silver nitrate aqueous solution was solely added during 11 minutes since the addition start of the silver nitrate aqueous solution. After that, the addition of the sodium behenate solution was started. During 14 minutes 15 seconds after the addition completion of the silver nitrate aqueous solution, the sodium behenate solution was solely added. The temperature within the reaction vessel was set at 30° C. and the solution temperature was maintained constant by means of an external temperature control. Further, the piping of the addition system for the sodium behenate solution was warmed by circulating warm water in the outer jacket of a double-walled tube so that the solution temperature at the outlet of the addition nozzle tip was adjusted to be 75° C. The piping of the addition system of the aqueous silver nitrate solution was also heat-controlled by circulating cold water in the outer jacket of a double-walled tube. The positions where the sodium behenate solution and the aqueous silver nitrate solution were added were arranged symmetrically in relation to the stirring axle in the center, and the height of the position was adjusted so as not to touch the reaction solution.

After the addition completion of the sodium behenate solution, the reaction solution was held at a temperature as it was for 20 minutes with stirring, and then the temperature was elevated up to 35° C. in 30 minutes. After that, the sodium behenate solution was ripened for 210 minutes. Immediately after ripening, the solid content was separated by centrifuge filtration, and then washed with water until electrical conductivity of the filtrate reached 30 μS/cm. Thus, a fatty acid silver salt was obtained. The obtained solid substance was stored as a wet cake (solid content: 45 wt %) without drying.

Shapes of the obtained silver behenate particles were evaluated in electron microscopic photography. The obtained silver behenate particles were scaly crystals having average values of a=0.14 μm, b=0.4 μm and c=0.6 μm, an average aspect ratio of 5.2, an average equivalent-sphere diameter of 0.52 μm and an average equivalent-sphere diameter variation coefficient of 15%. (a, b and c were according to the definition previously described in this specification).

19. kg of polyvinyl alcohol (PVA-217 manufactured by Kuraray Co., Ltd.) and water were added to the wet cake in an amount corresponding to 260 kg of dried solid content to make the entire amount 1,000 kg, and then the mixture was brought into a slurry by means of dissolver-blades. Further, the slurry was preliminarily dispersed with a pipeline-mixer (Model PM-10 manufactured by Mizuho Industry Co.).

Then, the preliminarily dispersed starting dispersion was processed three times with a dispersing machine (manufactured by Microfluidex International Corporation, trade name: Microfluidizer M-610 equipped with a Z-type interaction chamber) under a pressure adjusted to 1,260 kg/cm$^2$. Thus, the silver behenate dispersion was obtained. The dispersion temperature was set at 18° C. by adjusting a temperature of coolant. Cooling operation was performed by using coil type heat exchangers installed in front and behind the interaction chamber respectively.

<<Preparation of Reducing Agent-1 Dispersion>>

16 kg of water was added to 10 kg of Reducing Agent-1[1,1'-bis-(2-hydroxy-3,5-dimethylphenyl)-3,5,5-trimethylhexane] and 10 kg of a 20 wt % aqueous solution of modified polyvinylalcohol (Poval MP203manufactured by Kuraray Co., Ltd,) Then, the mixture was thoroughly mixed to be a slurry. The slurry was fed by means of a diaphragm pump into a horizontal type beads mill (UVM-2 manufactured by Imex Co., Ltd.) filled with zirconia beads having an average diameter of 0.5 mm, and dispersed for 3 hours 30 minutes. Then, 0.2 g of sodium salt of benzoisothiazolinone and water were added to the dispersion so as to make the concentration of the reducing agent 25 wt %, thereby Reducing Agent-1 Dispersion was obtained. The particles of the reducing agent included in the reducing agent dispersion thus obtained had a median particle diameter of 0.42 μm and a maximum particle diameter of 2.0 μm or less. The reducing agent dispersion obtained was filtrated with a polypropylene filter having a pore diameter of 10.0 μm to remove foreign matters like dusts, and then stored. The structure of Reducing Agent-1 used for the preparation is shown below.

(Reducing Agent-1)

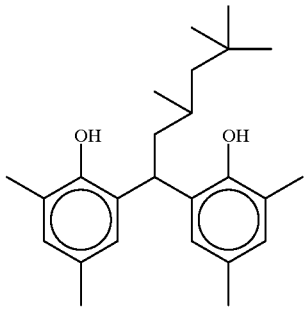

<<Preparation of Reducing Agent-2 Dispersion>>

16 kg of water was added to 10 kg of Reducing Agent-2[2,2'-isobutylidene-bis-(4,6-dimethylphenol)] and 10 kg of a 20 wt % aqueous solution of modified polyvinyl alcohol (Poval MP203 manufactured by Kuraray Co., Ltd.). Then, the mixture was thoroughly mixed to be a slurry. The slurry was fed by means of a diaphragm pump into a horizontal type beads mill (UVM-2 manufactured by Imex Co., Ltd.) filled with zirconia beads having an average diameter of 0.5 mm, and dispersed for 3 hours 30 minutes. Then, 0.2 g of sodium salt of benzoisothiazolinone and water were added to the dispersion so as to make the concentration of the reducing agent 25 wt %, thereby Reducing Agent-2 Dispersion was obtained. The particles of the reducing agent included in the reducing agent dispersion thus obtained had a median particle diameter of 0.38 μm and a maximum particle diameter of 2.0 μm or less. The reducing agent dispersion obtained was filtrated with a polypropylene filter having a pore diameter of 10.0 μm to remove foreign matters like dusts, and then stored. The structure of Reducing Agent-2 used for the preparation is shown below.

(Reducing Agent-2)

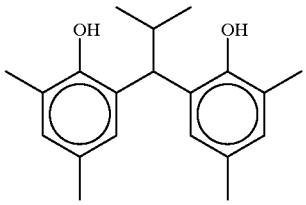

<<Preparation of Reducing Agent Complex-3 Dispersion>>

7.2 kg of water was added to 10 kg of Reducing Agent Complex-3 {1:1 complex of [2,2'-methylene bis-(4-ethyl-6-tert-butylphenol)] and triphenylphosphine oxide}, 0.12 kg of triphenylphosphine oxide and 16 kg of a 10 wt % aqueous solution of modified polyvinylalcohol (Poval MP203 manufactured by Kuraray Co. Ltd.). Then, the mixture was thoroughly mixed to be a slurry. The slurry was fed by means of a diaphragm pump into a horizontal type beads mill (UVM-2 manufactured by Imex Co., Ltd.) filled with zirconia beads having an average diameter of 0.5 mm, and dispersed for 4 hours 30 minutes. Then, 0.2 g of sodium salt of benzoisothiazolinone and water were added to the dispersion so as to make the concentration of the reducing agent 25 wt %, thereby Reducing Agent Complex-3 Dispersion was obtained. The particles of the reducing agent complex included in the reducing agent complex dispersion thus obtained had a median particle diameter of 0.46 μm and a maximum particle diameter of 1.6 m or less. The reducing agent complex dispersion obtained was filtrated with a polypropylene filter having a pore diameter of 3.0 μm to remove foreign matters like dusts, and then stored. The structure of Reducing Agent Complex-3 used for the preparation is shown below.

(Reducing Agent Complex-3)

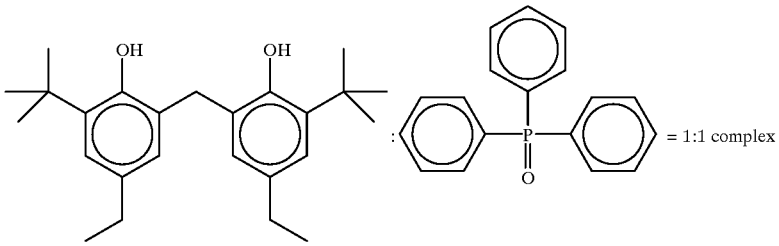

<<Preparation of Reducing Agent-4 Dispersion>>

6 kg of water was added to 10 kg of Reducing Agent-4 [2 2'-methylene bis-(4-ethyl-6-tert-butylphenol)] and 20 kg of a 10 wt % aqueous solution of modified polyvinylalcohol (Poval MP203 manufactured by Kuraray Co., Ltd.). Then, the mixture was thoroughly mixed to be a slurry. The slurry was fed by means of a diaphragm pump into a horizontal type beads mill (UVM-2 manufactured by Imex Co., Ltd.) filled with zirconia beads having an average diameter of 0.5 mm, and dispersed for 3 hours 30 minutes. Then, 0.2 g of sodium salt of benzoisothiazolinone and water were added to the dispersion so as to make the concentration of the reducing agent 25 wt %, thereby Reducing Agent-4 Dispersion was obtained. The particles of the reducing agent included in the reducing agent dispersion thus obtained had a median particle diameter of 0.40 μm and a maximum particle diameter of 1.5 μm or less. The reducing agent dispersion obtained was filtrated with a polypropylene filter having a pore diameter of 3.0 μm to remove foreign matters like dusts, and then stored. The structure of Reducing Agent-4 used for the preparation is shown below.

(Reducing Agent-4)

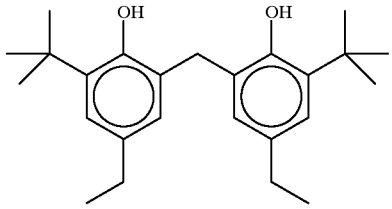

<<Preparation of Reducing Agent-5 Dispersion>>

6 kg of water was added to 10 kg of Reducing Agent-5 [2,2'-methylene bis-(4-methyl-6-tert-butylphenol)] and 20 kg of a 10 wt % aqueous solution of modified polyvinylalcohol (Poval MP203 manufactured by Kuraray Co., Ltd.). Then, the mixture was thoroughly mixed to be a slurry. The slurry was fed by means of a diaphragm pump into a horizontal type beads mill (UVM-2 manufactured by Imex Co., Ltd.) filled with zirconia beads having an average diameter of 0.5 mm, and dispersed for 3 hours 30 minutes. Then, 0.2 g of sodium salt of benzoisothiazolinone and water were added to the dispersion so as to make the concentration of the reducing agent 25 wt %, thereby Reducing Agent-5 Dispersion was obtained. The particles of the reducing agent included in the reducing agent dispersion thus obtained had a median particle diameter of 0.38 μm and a maximum particle diameter of 1.5 μm or less. The reducing agent dispersion obtained was filtrated with a polypropylene filter having a pore diameter of 3.0 μm to remove foreign matters like dusts, and then stored. The structure of Reducing Agent-5 used for the preparation is shown below.

(Reducing Agent-5)

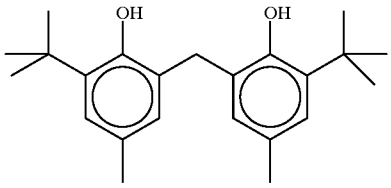

<<Preparation of Hydrogen Bonding Type Compound-1 Dispersion>>

10 kg of water was added to 10 kg of Hydrogen Bonding Type Compound-1 [tri(4-tert-butylphenyl) phosphine oxide and 20 kg of a 10 wt % aqueous solution of modified polyvinylalcohol (Poval MP203 manufactured by Kuraray Co., Ltd.). Then, the mixture was thoroughly mixed to be a slurry. The slurry was fed by means of a diaphragm pump into a horizontal type beads mill (UVM-2 manufactured by Imex Co., Ltd.) filled with zirconia beads having an average diameter of 0.5 mm, and dispersed for 3 hours 30 minutes. Then, 0.2 g of sodium salt of benzoisothiazolinone and water were added to the dispersion so as to make the concentration of the hydrogen bonding type compound 22 wt %, thereby Hydrogen Bonding Type Compound-1 Dispersion was obtained. The particles of the hydrogen bonding type compound included in the hydrogen bonding type compound dispersion thus obtained had a median particle diameter of 0.35 μm and a maximum particle diameter of 1.5 μm or less. The hydrogen bonding type compound dispersion obtained was filtrated with a polypropylene filter having a pore diameter of 3.0 μm to remove foreign matters like dusts, and then stored. The structure of Hydrogen Bonding Type Compound-1 used for the preparation is shown below.

(Hydrogen Bonding Type Compound-1)

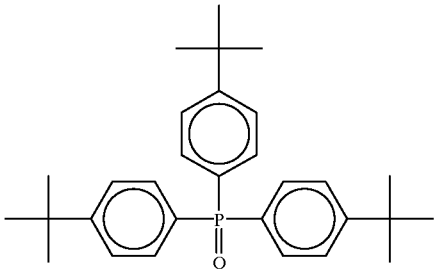

<<Preparation of Organic Polyhalogen Compound-1 Dispersion>>

16 kg of water was added to 10 kg of Organic Polyhalogen Compound-1 (2-tribromomethane sulfonylnaphthalene), 10 kg of a 20 wt % aqueous solution of modified polyvinylalcohol (Poval MP203 manufactured by Kuraray Co., Ltd.) and 0.4 kg of a 20 wt % aqueous solution of sodium tri-isopropylnaphthalenesulfonate. Then, the mixture was thoroughly mixed to be a slurry. The slurry was fed by means of a diaphragm pump into a horizontal type beads mill (UVM-2, manufactured by Imex Co., Ltd.) filled with zirconia beads having an average diameter of 0.5 mm, and dispersed for 5 hours. Then, 0. 2 g of sodium salt of benzoisothiazolinone and water were added to the dispersion so as to make the concentration of the organic polyhalogen compound 23.5 wt %, thereby Organic Polyhalogen Compound-1 Dispersion was obtained. The particles of the organic polyhalogen compound included in the organic polyhalogen compound dispersion thus obtained had a median particle diameter of 0.41 μm and a maximum particle diameter of 2.0 μm or less. The organic polyhalogen Compound dispersion obtained was filtrated with a polypropylene filter having a pore diameter of 10.0 μm to remove foreign matters like dusts, and then stored. The structure of Polyhalogen Compound-1 used for the preparation is shown below.

(Polyhalogen Compound-1)

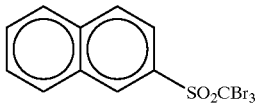

<<Preparation of Organic Polyhalogen Compound-2 Dispersion>>

14 kg of water was added to 10 kg of Organic Polyhalogen Compound-2 (tribromomethane sulfonylbenzene), 10 kg of a 20 wt % aqueous solution of modified polyvinylalcohol (Poval MP203 manufactured by Kuraray Co., Ltd.) and 0.4 kg of a 20 wt % aqueous solution of sodium tri-isopropylnaphthalenesulfonate. Then, the mixture was thoroughly mixed to be a slurry. The slurry was fed by means of a diaphragm pump into a horizontal type beads mill (UVM-2, manufactured by Imex Co., Ltd.) filled with zirconia beads having an average diameter of 0.5 mm, and dispersed for 5 hours. Then, 0.2g of sodium salt of benzoisothiazolinone and water were added to the dispersion so as to make the concentration of the organic polyhalogen compound 26 wt %, thereby Organic Polyhalogen Compound-2 Dispersion was obtained. The particles of the organic polyhalogen compound included in the organic polyhalogen compound dispersion thus obtained had a median particle diameter of 0.41 μm and a maximum particle diameter of 2.0 μm or less. The organic polyhalogen compound dispersion obtained was filtrated with a polypropylene filter having a pore diameter of 10.0 μm to remove foreign matters like dusts, and then stored. The structure of Polyhalogen Compound-2 used for the preparation is shown below.

(Polyhalogen Compound-2)

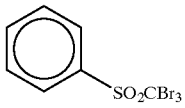

<<Preparation of Organic Polyhalogen Compound-3 Dispersion>>

8 kg of water was added to 10 kg of Organic Polyhalogen Compound-3 (N-butyl-3-tribromomethane sulfonylbenzamide), 20 kg of a 10 wt % aqueous solution of modified polyvinylalcohol (Poval MP203 manufactured by Kuraray Co., Ltd.) and 0.4 kg of a 20 wt % aqueous solution of sodium tri-isopropylnaphthalenesulfonate. Then, the mixture was thoroughly mixed to be a slurry. The slurry was fed by means of a diaphragm pump into a horizontal type beads mill (UVM-2, manufactured by Imex Co., Ltd.) filled with zirconia beads having an average diameter of 0.5 mm, and dispersed for 5 hours. Then, 0.2 g of sodium salt of benzoisothiazolinone and water were added to the dispersion so as to make the concentration of the organic polyhalogen compound 25 wt %. The dispersion was heated at 40° C. for 5 hours to obtain Organic Polyhalogen Compound-3 Dispersion. The particles of the organic polyhalogen compound included in the organic polyhalogen compound dispersion thus obtained had a median particle diameter of 0.36 μm and a maximum particle diameter of 1.5 μm or less. The organic polyhalogen compound dispersion obtained was filtrated with a polypropylene filter having a pore diameter of 3.0 μm to remove foreign matters like dusts, and then stored. The structure of Polyhalogen Compound-3 used for the preparation is shown below.

(Polyhalogen Compound-3)

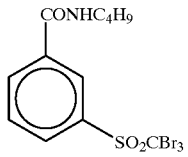

<<Preparation of Phthalazine Compound-1 Solution>>

8 kg of modified polyvinylalcohol (MP203 manufactured by Kuraray Co., Ltd.) was dissolved in 174.57 kg of water. Then, 3.15 kg of a 20 wt % aqueous solution of sodium tri-isopropylnaphthalene sulfonate and 14.28 kg of a 70 wt % aqueous solution of Phthalazine Compound-1 (6-isopropylphthalazine) were added to the foregoing solution to prepare a 5 wt % solution of Phthalazine Compound-1. The structure of Phthalazine Compound-1 used for the preparation is shown below.

(Phthalazine Compound-1)

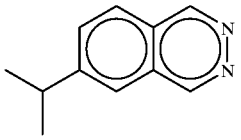

<<Preparation of Mercapto Compound-1 Aqueous Solution>>

7 g of Mercapto Compound-1 [sodium salt of 1-(3-sulfophenyl)-5-mercaptotetrazole] was dissolved in 993 g of water to obtain a 0.7 wt % aqueous solution. The structure of Mercapto Compound-1 used for the preparation is shown below.

(Mercapto Compound-1)

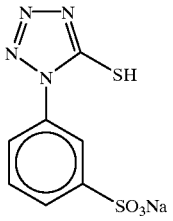

<<Preparation of Pigment-1 Dispersion>>

250 g of water was added to 64 g of the blue pigment (C.I. Pigment Blue 60) and 6.4 g of Demol N (manufactured by Kao Corporation). Then, the mixture was thoroughly mixed to be a slurry. 800 g of zirconia beads having an average diameter of 0.5 mm was prepared and charged in a vessel together with the slurry. The slurry was dispersed for 25 hours with a dispersing machine (¼ G Sand-Grinder Mill manufactured by Imex Co., Ltd.) to obtain Pigment-1 Dispersion. The pigment particles included in the pigment dispersion thus obtained had an average particle diameter of 0.21 μm.

<<Preparation of SBR Latex Liquid>>

A SBR latex having Tg=23 °C. was prepared as follows.

By using ammonium persulfate as an initiator and an anionic surfactant as an emulsifier, emulsion polymerization of monomers in a ratio of styrene (70.5 wt %)/butadiene (26.5 wt %)/acrylic acid (3 wt %) was performed, and then the obtained liquid was subjected to aging at 80° C. for 8 hours. After that, the liquid was cooled down to 40° C. and adjusted with ammonia water to a pH of 7.0. Further Sundet BL (manufactured by Sanyo Chemical Industries ) was added so as to be 0.22% in the liquid. Then, the liquid was adjusted to a pH of 8.3 by adding a 5% aqueous solution of sodium hydroxide, and further adjusted to a pH of 8.4 by adding ammonia water. At that time, the molar ratio between $Na^+$ ion and $NH4^+$ ion used was 1:2.3. Furthermore, to 1 kg of the liquid, 0.15 ml of a 7% aqueous solution of sodium salt of benzoisothiazolinone was added to prepare SBR Latex Liquid.

(SBR Latex: a latex of —St(70.5)—Bu(26.5)—AA(3)] Tg 23° C.

Average particle diameter: 0.1 μm, concentration: 43 wt %, equilibrium moisture content at 25° C. and a relative humidity of 60%: 0.6 wt %, ionic conductivity: 4.2 mS/cm {the ionic conductivity was measured with a conductometer, CM-30S, manufactured by Toa Denpa Kogyo Co., Ltd. and the starting solution of latex (43 wt %) was measured at 25° C.}, and pH: 8.4.

A SBR latex having a different Tg was prepared in the same process as that described in the above, except that a ratio of butadiene was adequately changed.

<<Preparation of Image-Forming Layer Coating Solution-1>>

1,000 g of Fatty Acid Silver Salt Dispersion obtained in the above, 125 ml of water, 113 g of Reducing Agent-1 Dispersion, 91 g of Reducing Agent-2 Dispersions 27 g of Pigment-1 Dispersion, 82 g of Organic Polyhalogen Compound-1 Dispersion, 40 g of Organic Polyhalogen Compound-2 Dispersion, 173 g of Phthalazille Compound-1 Solution, 1,082 g of SBR Latex (Tg: 20.5° C.) Liquid and 9 g of Mercapto Compound-1 Aqueous Solution were added in this order. Immediately before coating, 158 g of Silver Halide Mixed Emulsion A for Coating Solution was added to the foregoing mixture and mixed thoroughly to obtain an image-forming layer (an emulsion layer, or a photosensitive layer) coating solution. The coating solution was fed to a coating die as it was to be coated.

Viscosity of the image-forming layer coating solution was 85 [mPa·s] at 40° C. (No. 1 rotor at 60 rpm) measured with a Model B viscometer (manufactured by Tokyo Keiki Co., Ltd.).

The viscosity of the coating solution measured with an RFS Fluid Spectrometer (manufactured by Rheometrics Far East Co.) at 25° C. was 1500, 220, 70, 40, 20 [mPa·s] at each shearing velocity of 0.1, 1, 10, 100, 1000 [1/sec] respectively.

<<Preparation of Image-Forming Layer Coating Solution-2>>

1,000 g of Fatty Acid Silver Salt Dispersion obtained in the above, 104 ml of water, 30 g of Pigment-1 Dispersion, 21 g of Organic Polyhalogen Compound-2 Dispersion, 69 g of Organic Polyhalogen Compound-3 Dispersion, 173 g of Phthalazine Compound-1 Solution, 1,082 g of SBR Latex (Tg: 23° C.) Liquid, 258 g of Reducing Agent Complex-3 Dispersion and 9 g of Mercapto Compound-1 Aqueous Solution were added in this order. Immediately before coating, 110 g of Silver Halide mixed Emulsion A for Coating Solution was added to the foregoing mixture and mixed thoroughly to obtain an image-forming layer coating solution. The coating solution was fed to a coating die as it was to be coated.

<<Preparation of Image-Forming Layer Coating Solution-3>>

1,000 g of Fatty Acid Silver Salt Dispersion obtained in the above, 95 ml of water, 73 g of Reducing Agent-4 Dispersion, 68 g of Reducing Agent-5 Dispersion, 30 g of Pigment-1 Dispersion, 21 g of Organic Polyhalogen Compound-2 Dispersion, 69 g of Organic Polyhalogen Compound-3 Dispersion, 173 g of Phthalazine Compound-1 Solution, 1,082 g of an SBR core-shell type latex (core Tg: 20° C./shell Tg: 30° C. =70/30 ratio by weight) liquid, 124 g of Hydrogen Bonding Type Compound-i Dispersion and 9 g of Mercapto Compound-1 Aqueous Solution were added in this order. Immediately before coating, 110 g of Silver Halide Mixed Emulsion A for Coating Solution was added to the foregoing mixture and mixed thoroughly to obtain an image-forming layer coating solution. The coating solution was fed to a coating die as it was to be coated.

<<Preparation of Interlayer Coating Solution for Image-Forming Surface>>

2 ml of a 5 wt % aqueous solution of Aerosol OT (manufactured by American Cyanamide Co.) and 10.5 ml of a 20 wt % aqueous solution of diammonium phthalate were added to 772 g of a 10 wt % aqueous solution of polyvinyl alcohol (PVA-205manufactured by Kuraray Co. , Ltd.), 5.3 g of a 20 wt % dispersion of Pigment-1 and 226 g of a 27.5 wt % solution of a latex of a methyl methacrylate/styrene/butyl acrylate/hydroxyethyl methacrylate/acrylic acid copolymer (copolymerization ratio by weight: 64/9/20/5/2). Water was added to the foregoing mixture to make the total weight 880 g. A pH value of the mixture was adjusted with NaOH up to 7.5 to obtain the interlayer coating solution. The coating solution was fed to a coating die so as to be a coating amount of 10 ml/$M^2$.

The viscosity of the coating solution was 21 [mPa·s] at 40° C. (No. 1 rotor at 60 rpm) measured with a Model B viscometer.

<<Preparation of First Protective Layer Coating Solution for Image-Forming Surface>>

64 g of inert gelatin (manufactured by Nitta Gelatin Inc.) was dissolved in water. To the gelatin solution, 80 g of a 27.5 wt % liquid of a latex of a methyl methacrylate/styrene/butyl acrylate/hydroxyethyl methacrylate/acrylic acid copolymer (copolymerization ratio by weight: 64/9/20/5/2), 23 ml of a 10 wt % methanol solution of phthalic acid, 23 ml of a 10 wt % aqueous solution of 4-methyl phthalic acid, 28 ml of sulfuric acid at a concentration of 0.5 mol/L, 5 ml of a 5 wt % aqueous solution of Aerosol OT (manufactured by American Cyanamid Co.), 0.5 g of phenoxyethanol and 0.1 g of benzoisothiazolinone were added. Then, water was added thereto to make the total weight 750 g, thereby the coating solution was obtained. Immediately before coating, 26 ml of a 4 wt % chrome alum solution was mixed into the coating solution by using a static mixer, then the coating solution was fed to a coating die so as to be a coating amount of 18.6 ml/$m^2$.

The viscosity of the coating sOlution was 17 [mPa·s] at 40° C. (No. 1 rotor at 60 rpm) measured with a Model B viscometer.

<<Preparation of Second Protective Layer Coating Solution for Image-Forming Surface>>

80 g of inert gelatin was dissolved in water. To the gelatin solution, 102 g of a 27.5 wt % solution of a latex of a methyl methacrylate/styrene/butyl acrylate/hydroxyethyl methacrylate/acrylic acid copolymer (copolymerization ratio by weight: 64/9/20/5/2), 3.2 ml of a 5 wt % solution of a fluorine type surfactant (F-1: potassium salt of N-perfluoroctylsulfonyl-N-propyl glycine), 32 ml of a 2 wt % aqueous solution of a fluorine type surfactant [F-2: polyethyleneglycol mono (N-perfluoroctylsulfonyl-N-propyl-2-aminoethyl) ether (average degree of polymerization of polyethylene oxide=15)], 23 ml of a 5 wt % solution of Aerosol OT (manufactured by American Cyanamid Co.), 4 g of polymethyl methacrylate fine particles (average particle diameter: 0.7 $\mu$m), 21 g of polymethyl methacrylate fine particles (average particle diameter: 4.5 $\mu$m), 1.6 g of 4-methyl phthalic acid, 4.8 g of phthalic acid, 44 ml of sulfuric acid at a concentration of 0.5 mol/L, and 10 mg of benzoisothiazolinone were added. Then, water was added thereto to make the total weight 650 g. Immediately before coating, 445 ml of an aqueous solution containing 4 wt % of chrome alum and 0.67 wt % of phthalic acid was mixed into the foregoing mixture by using a static mixer to obtain the second surface protective layer coating solution. The coating solution was fed to a coating die so as to be a coating amount of 8.3 ml/$m^2$.

The viscosity of the coating solution was 9 [mPa·s] at 40° C. (No. 1 rotor at 60 rpm) measured with a Model B viscometer.

<<Preparation of Heat-Developable Photosensitive Material Sample 1 to 13>>

On the back side surface of the undercoated support, the anti-halation layer coating solution in a coating amount of 0.04 g/$m^2$ calculated in terms of a solid content of the solid fine particle dye and the back surface protective layer coating solution in a coating amount of 1.7 g/$m^2$ calculated in terms of gelatin were simultaneously multi-layer coated and dried, thereby the back layer was prepared.

On the opposite surface of the back surface, the image-forming layer, the interlayer, the first protective layer and the second protective layer were simultaneously multi-layer coated by using a slide bead coating method in this order started from the undercoated surface, thereby a sample of heat-developable photosensitive material was prepared. At that time, the image-forming layer coating solution and the interlayer coating solution were maintained at 31° C., the first protective layer coating solution was maintained at 36° C. and the second protective layer coating solution was maintained at 37° C. by temperature control respectively.

The coated amount (g/m$^2$) of each compound in the image-forming layer is shown below.

Silver behenate 6.19
Reducing Agent-1 0.67
Reducing Agent-2 0.54
Pigment (C.I.Pigment Blue 60) 0.032
Polyhalogen Compound-1 0.46
Polyhalogen Compound-2 0.25
Phthalazine Compound-1 0.21
SBR latex 11.1
Mercapto Compound-1 0.002
Silver halide (in terms of silver) 0.145

The conditions of coating and drying are described below.

Coating was performed at a coating speed of 160 m/min. The distance between the tip of coating die and the support was set in the range from 0.10 mm to 0.30 mm. A pressure in a reduced pressure chamber was set lower than the atmospheric pressure by 196 Pa to 882 Pa. The support was electrically discharged with ionized air before coating.

After the coated solution was chilled in a subsequent chilling zone with air at a dry bulb temperature of 10° C. to 20° C., the coated support was transported by non-contact type web handling, and dried with drying air at a dry bulb temperature of 23° C. to 45° C. and at a wet bulb temperature of 15° C. to 21° C. by means of a helical floating type drying zone.

After drying, the film surface was conditioned at 25° C. and a relative humidity from 40% to 60%, and then heated up to a temperature from 70° C. to 90° C. After being heated up, the film surface wag cooled down to 25° C.

Matting degrees of the prepared heat-developable photosensitive material were 550 seconds on the surface of the image-forming layer and 130 seconds on the back surface respectively measured in the Beck's degree of smoothness. The pH value of the film surface on the side of the image-forming layer was measured as 6.0.

<<Evaluation of Properties of Heat-Developable Photosensitive Material Samples 1 to 13>>

(1) Evaluation of Photographic Properties

Photographic materials were exposed with Fuji Medical Dry Laser Imager, FM-DP L [equipped with a 660 nm semiconductor laser having the maximum output of 60 mW (IIIB)], and then heat-developed (for 24 seconds in total with four plates of panel heaters respectively set at 112° C.—119° C.—121° C.—121° C.). When the obtained images were evaluated by means of a densitometer, each sample showed an excellent photosensitivity and maximum density.

(2) Evaluation of Adhesion Property

On the surface where the image-forming layer of the sample had been coated, a grid consisting of twenty-five squares was made by cutting six slits both longitudinally and laterally each with a space of 4 mm by means of a razor, provided that the depth of these slits reached the surface of the support. On the grid, a Mylar tape having a width of 25 mm was adhered and pressed sufficiently. In five minutes after pressing, the Mylar tape was peeled off rapidly from the sample in an angle of 180 degree. The result was regarded as an adhesion property of a raw sample (before processing). The numbers of squares where the image-forming layer was peeled off from the sample were counted and classified as described in the following.

○: no number of squares peeled off

Δ: numbers of squares peeled off are less than five

×: numbers of squares peeled off are five or more

Further, the same evaluation was conducted for samples which were heat-developed by pressing to a heat-developing drum at 120° C. for 25 seconds. The result was regarded as an adhesion property of a sample after processing.

(3) Evaluation of Mechanical Stability

By using a Maroon stability tester (manufactured by Kumagaya Science & Industry Co.), shearing power was given the undercoat layer coating solutions under conditions of 25° C., 25 kg, 1,200 rpm and 10 minutes. After that, coagulation content was filtered with a metal net of 400 mesh. The dried weight of filtered coagulation content was measured and the ratio of coagulation was obtained from the equation described below.

The coagulation ratio (%)=[weight of dried coagulation content (g)/weight of solid content before testing (g)]×100

As criteria for evaluation, × means that the coagulation ratio is 0.1% or more, and ○ means that the coagulation ratio is less than 0.1%. When the coagulation ratio is 0.1% or more, aggregates were generated in a coating process (in a coating die part). The aggregates cause coating stripes to give an inferior surface condition.

(4) Counting Foreign Matters

Numbers of adhered foreign matters were counted with human eyes in observing 10 m$^2$ of the surface coated with the image-forming layer of a sample. These foreign matters are preferably less. It is necessary that the counted numbers are 30 pieces/10 m$^2$ at most. It is more preferable that the counted numbers are 20 pieces/10 m$^2$ or less. When an image-forming layer is coated on an undercoat layer having a lot of foreign matters, unfavorable repelling marks are generated.

The evaluation results of properties of Heat-Developable Photosensitive Material Sample 1 to 13 are shown in TABLE 1 below.

TABLE 1

| | Polyester Resin | | | | | Condition: Film Thickness d of Undercoat Layer | Condition: k/d | Evaluation: Numbers of Foreign Substances | Evaluation: Mechanical Stability | Evaluation: Adhesion Raw | Evaluation: Adhesion After Processing | Note |
|---|---|---|---|---|---|---|---|---|---|---|---|---|
| | A | B | C | D | E | | | | | | | |
| Sample 1 | 80 | — | — | 20 | — | 0.2 | 2.0 | 30 | ○ | ○ | ○ | Inv |
| Sample 2 | — | — | 80 | 20 | — | 0.2 | 2.0 | 30 | ○ | ○ | ○ | Inv |
| Sample 3 | — | 80 | — | 20 | — | 0.2 | 2.0 | 25 | ○ | ○ | ○ | Inv |
| Sample 4 | — | 80 | — | 20 | — | 0.1 | 4.0 | 10 | ○ | ○ | ○ | Inv |

TABLE 1-continued

| | Polyester Resin | | | | | Condition: Film Thickness d of Undercoat Layer | k/d | Evaluation: Numbers of Foreign Substances | Mechanical Stability | Adhesion: Raw | Adhesion: After Processing | Note |
|---|---|---|---|---|---|---|---|---|---|---|---|---|
| | A | B | C | D | E | | | | | | | |
| Sample 5 | — | 80 | — | 20 | — | 0.05 | 8.0 | 10 | ○ | ○ | ○ | Inv |
| Sample 6 | — | 100 | — | — | — | 0.4 | 1.0 | 100 | ○ | ○ | ○ | Comp |
| Sample 7 | — | — | 100 | — | — | 0.4 | 1.0 | 100 | ○ | ○ | ○ | Comp |
| Sample 8 | — | — | — | 100 | — | 0.4 | 1.0 | 70 | ○ | ○ | ○ | Comp |
| Sample 9 | — | — | — | — | 100 | 0.4 | 1.0 | 10 | × | × | Δ | Comp |
| Sample 10 | — | — | — | 100 | — | 0.2 | 2.0 | 50 | ○ | ○ | ○ | Comp |
| Sample 11 | — | 80 | — | 20 | — | 0.6 | 0.7 | 100 | ○ | ○ | ○ | Comp |
| Sample 12 | — | 80 | — | 20 | — | 0.03 | 13.0 | 10 | ○ | × | × | Comp |
| Sample 13 | — | 80 | — | 20 | — | 1.2 | 3.0 | 10 | ○ | ○ | × | Comp |

Inv: The Present Invention
Comp: The Comparative Example

Each of the polyester resin A to E in TABLE 1 indicates the following material.

A: A polyester aqueous dispersion (Tg=35° C., solid content: 25 wt %)

(91 mol % of terephthalic acid and/or isophthalic acid as a sum and 9 mol % of isophthalic acid having a sulfonyloxy group: —$(SO_3)_nM$; 80 mol % of diethylene glycol and 20 mol % of cyclohexane dimethanol)

B: A polyester aqueous dispersion (Tg=52° C., solid content: 30 wt %)

(85 mol % of terephthalic acid and/or isophthalic acid as a sum and 15 mol % of isophthalic acid having a sulfonyloxy group: —$(SO_3)_nM$; 54 mol % of diethylene glycol and 46 mol % of cyclohexane dimethanol)

C: Vylonal MD-1245 manufactured by Toyobo Co., Ltd.

A polyester aqueous dispersion (containing Butyl Cellosolve, Tg=61° C., solid content: 30 wt %)

D; Vylonal MD-1200 manufactured by Toyobo Co., Ltd.

A polyester aqueous dispersion (containing Butyl Cellosolve, Tg=67° C., solid content: 34 wt %)

E: Pesresin A-515GB manufactured by Takamatsu Oil & Fat, Inc.

An acryl-modified polyester aqueous dispersion (Tg=60° C., solid content: 30 wt %)

It is clear that the heat-developable photosensitive material of the invention has superior properties such as strong adhesion between the support and the image-forming layer and excellence in mechanical stability. Further, any sample of the heat-developable photosensitive materials of the invention shows a good mechanical stability, have foreign matters of 30 pieces/10 $m^2$ or less, and good property without repelling marks

Example 2

Heat-Developable Photosensitive Material Sample 14 to 21 were prepared in the same manner as that in EXAMPLE 1, except that the fine particles of non-cross-linking type polymethylmethacrylate was replaced by that having an average particle diameter indicated in TABLE 2 and the polyester resin was also replaced by that indicated in TABLE 2. Sample 14 was prepared without adding the fine particles of non-cross-linking type polymethylmethacrylate. In the same manner as that in EXAMPLE 1, the amount of polyester resin is used so as to obtain a dried film thickness of an undercoat layer described in TABLE 2. Evaluation was conducted in the same manner as that in EXAMPLE 1 to give the results described in TABLE 2.

TABLE 2

| | Condition: Polyester Resin | | | Average Diameter k of Fine Particles | Film Thickness d of Undercoat Layer | K/d | Evaluation: Numbers of Foreign Substances | Mechanical Stability | Adhesion: Raw | Adhesion: After Processing | Note |
|---|---|---|---|---|---|---|---|---|---|---|---|
| | B | D | E | | | | | | | | |
| Sample 14 | 80 | 20 | | — | 0.1 | 0 | 80 | ○ | ○ | ○ | Comp |
| Sample 15 | 80 | 20 | | 0.5 | 0.2 | 2.5 | 25 | ○ | ○ | ○ | Inv |
| Sample 16 | 90 | 10 | | 0.5 | 0.1 | 5.0 | 10 | ○ | ○ | ○ | Inv |
| Sample 17 | 80 | | 20 | 2.0 | 0.3 | 6.7 | 10 | ○ | Δ | ○ | Inv |
| Sample 18 | 80 | | 20 | 2.0 | 1.0 | 2.0 | 10 | ○ | Δ | ○ | Inv |
| Sample 19 | | | 100 | 0.5 | 0.3 | 1.7 | 10 | × | × | × | Comp |

TABLE 2-continued

| | Polyester Resin | | | Condition: Average Diameter k of Fine Particles | Condition: Film Thickness d of Undercoat Layer | Condition: K/d | Evaluation: Numbers of Foreign Substances | Evaluation: Mechanical Stability | Evaluation: Adhesion Raw | Evaluation: Adhesion After Processing | Note |
|---|---|---|---|---|---|---|---|---|---|---|---|
| | B | D | E | | | | | | | | |
| Sample 20 | | | 100 | 2.5 | 0.3 | 8.3 | 25 | × | × | Δ | Comp |
| Sample 21 | | | 100 | 2.5 | 1.0 | 2.5 | 10 | × | × | Δ | Comp |

Inv: The Present Invention
Comp: The Comparative Example

From the results shown in TABLE 2, the cases where an acrylic modified polyester resin was used (Sample 17 & 18) are slightly inferior in mechanical stability and adhesion (in a raw state) to the cases where a polyester resin without acrylic modification was solely used (Sample 15 & 16). However, it is recognized that the cases where the acrylic modified polyester resin was used (Sample 17 & 18) show less numbers of foreign matters of 10 pieces/10 $m^2$ and good adhesion (after processing), so that these cases have excellent properties in practical use.

Example 3

<<Preparation of Heat-Developable Photosensitive Material Sample 22>>

Heat-Developable Photosensitive Material Sample 22 was prepared in the same manner as that in Heat-Developable Photosensitive Material Sample 4 in EXAMPLE 1, except that Image-Forming Layer Coating solution-1 was changed to Image-Forming Layer Coating Solution-2 and further Yellow Dye Compound 14 was eliminated form the anti-halation layer.

At that time, the coated amount (g/$m^2$) of each compound in the image-forming layer is as follows.

Silver behenate 6.19
Pigment (C.I.Pigment Blue 60) 0.036
Polyhalogen Compound-2 0.13
Polyhalogen Compound-3 0.41
Phthalazine Compound-1 0.21
SBR latex 11.1
Reducing Agent Complex-3 1.54
Mercapto Compound-1 0.002
Silver halide (in terms of silver) 0.10

<<Preparation of Heat-Developable Photosensitive Material Sample 23>>

Heat-Developable Photosensitive Material Sample 23 was prepared in the same manner as that in Heat-Developable Photosensitive Material Sample 4 in EXAMPLE 1, except that Image-Forming Layer Coating Solution-1 was changed to Image-Forming Layer Coating Solution-3, Yellow Dye Compound 14 was eliminated form the anti-halation layer, and fluorine type surfactants, F-1, F-2, F-3 and F-4 in both the second protective layer and the back surface protective layer were changed to F-5, F-6, F-7 and F-8 in the same weight.

At that time, the coated amount (g/$m^2$) of each compound in the image-forming layer is described below. The structures of fluorine type surfactants, F-5, F-6, F-7 and F-8 used for preparation are shown below.

(F-5)

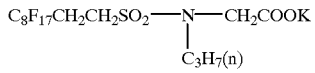

(F-6)

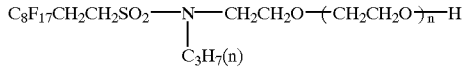

$n$ = 15 (average)

(F-7)

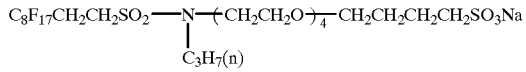

(F-8)

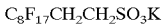

Silver behenate 5.57
Pigment (C.I.Pigment Blue 60) 0.032
Reducing Agent-4 0.40
Reducing Agent-5 0.36
Polyhalogen Compound-2 0.12
Polyhalogen Compound-3 0.37
Phthalazine Compound-1 0.19
SBR latex 10.0
Hydrogen Bonding Type Compound-1 0.59
Mercapto Compound-1 0.002
Silver Halide (in terms of silver) 0.09

Regarding Sample 22 and 23, the same effects as Sample 4 were confirmed. From these results, it is clearly recognizable that the effects to be achieved by the invention can be obtainable even when the composition of image-forming layer coating solution is changed, even whether the yellow dye compound exists or not in the anti-halation layer, or even when the kinds of fluorine type surfactants are changed.

According to the present invention, a heat-developable recording material having an undercoat layer which results in strong adhesion between the support and the image-forming layer, excellent condition of coated surface and improvement of repelling marks in coating the image-forming layer can be provided.

What is claimed is:

1. A heat-developable recording material comprising a support, at least one undercoat layer and at least one image-forming layer, in this order, wherein the undercoat layer comprises:

polyester resins containing at least two kinds of water-soluble and water-dispersible polyester resins, each of which has a different glass transition temperature (Tg); and fine particles having an average particle diameter (k) of from 0.1 $\mu$m to 2.0 $\mu$m, and the undercoat layer has an average film thickness (d) of from 0.05 $\mu$m to 1.0 $\mu$m, and (k)/(d) is in the range from 2.0 to 10.0.

2. The heat-developable recording material as claimed in claim 1, wherein all of the polyester resins in the undercoat layer are a polyester resin without an acrylic modification.

3. The heat-developable recording material as claimed in claim 1, wherein all of the polyester resins in the undercoat layer have a Tg of from 30° C. to 100° C.

4. The heat-developable recording material as claimed in claim 1, wherein at least one of the polyester resins is a polyester resin which satisfies Condition A:

the polyester resin has a Tg of from 40° C. to 100° C.;

an acid component of the polyester resin comprises: at least one of a terephthalic acid and isophthalic acid in a total amount of from 40 mol % to 90 mol %; and an isophthalic acid having a sulfonyloxy group below in an amount of from 10 mol % to 60 mol %: —$(SO_3)_n$M, wherein M represents a hydrogen atom, an alkali or alkali-earth metal, or a tertiary ammonium group; and an alcohol component of the polyester resin comprises a diethylene glycol in an amount of from 40 mol % to 90 mol % and a cyclohexane dimethanol in an amount of from 10 mol % to 60 mol %.

5. The heat-developable recording material as claimed in claim 4, wherein the polyester resins comprise: the polyester resin which satisfies Condition A in an amount of from 60 wt % to 90 wt %; and a polyester resin having a higher Tg than the polyester resin that satisfies Condition A in an amount of from 10 wt % to 40 wt %.

6. The heat-developable recording material as claimed in claim 1, wherein the undercoat layer contains the fine particles in an amount of from 0.1 wt % to 10 wt % in proportion to the amount of the polyester resin.

7. The heat-developable recording material as claimed in claim 1, wherein the image-forming layer comprises at least one kind of photosensitive silver halide, a non-photosensitive organic silver salt, a reducing agent for a silver ion and a binder.

* * * * *